US007840162B2

(12) United States Patent
Suzuki

(10) Patent No.: US 7,840,162 B2
(45) Date of Patent: Nov. 23, 2010

(54) IMAGE FORMING APPARATUS IN WHICH AXIS DEVIATION OF ROTATING MEMBER IS PREVENTED

(75) Inventor: Nobutaka Suzuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 1047 days.

(21) Appl. No.: 11/552,455

(22) Filed: Oct. 24, 2006

(65) Prior Publication Data

US 2007/0115306 A1 May 24, 2007

(30) Foreign Application Priority Data

Oct. 28, 2005 (JP) ..... 2005-313809
Oct. 28, 2005 (JP) ..... 2005-313810
Oct. 28, 2005 (JP) ..... 2005-313811

(51) Int. Cl.
*G03G 15/00* (2006.01)

(52) U.S. Cl. ..... 399/167

(58) Field of Classification Search ..... 399/167, 399/116, 111, 110
See application file for complete search history.

(56) References Cited

U.S. PATENT DOCUMENTS 5,371,576 A * 12/1994 Gonda ..... 399/167
5,398,097 A * 3/1995 Satoh et al. ..... 399/111
5,420,664 A * 5/1995 Miwa et al. ..... 399/167
5,708,933 A * 1/1998 Nogami et al. ..... 399/167
5,745,825 A 4/1998 Okawa et al.
5,878,310 A * 3/1999 Noda et al. ..... 399/117
6,438,341 B1 8/2002 Matsuoka
6,510,298 B1 * 1/2003 Kobayashi et al. ..... 399/167
7,003,245 B2 * 2/2006 Leemhuis et al. ..... 399/116
7,184,687 B2 * 2/2007 Yamaguchi et al. ..... 399/111
7,228,090 B2 * 6/2007 Toso et al. ..... 399/167
7,245,858 B2 * 7/2007 Okada et al. ..... 399/167
2002/0172531 A1 * 11/2002 Harada et al. ..... 399/167
2006/0051131 A1 * 3/2006 Takigawa
2006/0285879 A1 * 12/2006 Yamaguchi et al. ..... 399/111

FOREIGN PATENT DOCUMENTS

JP 62-065049 3/1987
JP 63-004252 1/1988
JP 10214001 A 8/1998
JP 10254327 A 9/1998
JP 2001082474 A 3/2001
JP 2001221227 A 8/2001
JP 2003005475 A 1/2003
JP 2004183860 A 7/2004
JP 2004246374 A 9/2004
JP 2005099231 A 4/2005

OTHER PUBLICATIONS

European Search Report for corresponding European patent application No. 06022532.3-2209 lists the references above, Mar. 19, 2007.

* cited by examiner

*Primary Examiner*—Susan S Lee
(74) *Attorney, Agent, or Firm*—DLA Piper LLP (US)

(57) ABSTRACT

An image forming apparatus includes a main body and a rotating member unit having a rotating member. The rotating member unit is detachably held in the main body. The main body of the image forming apparatus has a retainer which retains a shaft penetrating and supporting the rotating member, and the retainer has a first shaft retaining member which supports the shaft at a front side as seen from the insertion direction of the rotating member unit.

14 Claims, 17 Drawing Sheets

IMAGE FORMING APPARATUS IN WHICH AXIS DEVIATION OF ROTATING MEMBER IS PREVENTED

CROSS-REFERENCE TO RELATED APPLICATIONS

This application is based upon and claims the benefit of priority from prior Japanese Patent Applications No. 2005-313809, No. 2005-313810, and No. 2005-313811, filed Oct. 28, 2005, the entire contents of which are incorporated herein by reference.

BACKGROUND

1. Technical Field

The present invention relates to an image forming apparatus having a main body in which a rotating member such as an image carrier and a development roller is retained.

2. Related Art

As for image forming apparatus such as an electrophotographic copying machine and a printer, conventionally there has been employed a structure comprising a drum drive shaft and a drive shaft receiving part. The drum drive shaft is supported by a side plate of a main body and is driven to rotate by a chain sprocket. The drive shaft receiving part is formed in a resin flange which is fitted and fixed to an end of the image carrier drum. The drum drive shaft is fitted in the drive shaft receiving part, thereby conducting positioning of the image carrier drum. Also in this structure, a drive transmitter retained by the drum drive shaft is engaged with a drive transmitter receiving part formed in the resin flange, thereby rotating the image carrier drum (JP-A-62-65049).

There has been also employed another structure in which a drum drive gear as a spiral gear provided on a main body is meshed with a drum gear as a spiral gear fixed to one end of an image carrier drum, thereby rotating the image carrier drum (JP-A-63-4252).

However, attached to the both ends of the shaft of the image carrier drum are separate members, respectively. Accordingly, the coaxiality of the ends of the shaft is deteriorated so as to increase axis deviation and thus deteriorate the accuracy of position of the image carrier drum. Especially in case of a tandem-type color printer in which a plurality of image carrier drums are aligned, desired color can not be obtained unless respective colors are superposed on each other to an accuracy of several tens of micron meters. Accordingly, the deterioration of the coaxiality and the axis deviation constitute serious factor of decreasing the accuracy.

In case that an image carrier drum is driven by a gear, the larger the gear the larger the number of teeth thereof is, thereby improving the accuracy and reducing the irregularity in rotation, thus improving the quality. However, in case that there is a gear integrated with the image carrier drum and the gear has an outer size larger than the outer size of the process cartridge, the gear may be caught by an intermediate transferring member or the like in an image forming apparatus during the operation for replacing the process cartridge, thus making the attachment and detachment operation difficult.

SUMMARY

It is an object of the invention to solve the aforementioned problems and to provide an image forming apparatus in which the axis deviation of a rotating member is prevented so as to provide improved axial accuracy and which is allowed to have larger outer size of a rotating member driving means, thereby reducing the irregularity in rotation and thus improving the accuracy.

To solve the aforementioned problems, there is provided an image forming apparatus comprising a main body and a rotating member unit having a rotating member, the rotating member unit being detachably held in the main body, wherein the main body of the image forming apparatus has a retainer which retains a shaft penetrating and supporting the rotating member, and the retainer has a first shaft retaining member which supports the shaft at a front side as seen from the insertion direction of the rotating member unit.

It is preferable that the rotating member unit has the shaft penetrating and supporting the rotating member.

Further, it is preferable that the main body has the shaft penetrating and supporting the rotating member.

Further, it is preferable that the image forming apparatus has a second shaft retaining member which retains the shaft at a rear side as seen from the insertion direction of the rotating member unit.

Further, it is preferable that the second shaft retaining member is allowed to be opened and closed.

Further, it is preferable that the main body of the image forming apparatus is provided with a rotating member driving section for driving the rotating member, the rotating member driving section has a rotating member driving means, and the rotating member driving means is disposed between the first shaft retaining member and the rotating member and retained on the main body side of the image forming apparatus in a state that the rotating member is inserted.

Further, it is preferable that the image forming apparatus comprises a rotating member driving means retaining portion for preventing the rotating member driving means from coming off.

Further, it is preferable that the rotating member driving means is a gear, and the moving distance of the gear from the state that the rotating member unit is inserted to the state that the rotating member unit is not inserted is shorter than the height of the tooth of the gear.

Further, it is preferable that the rotating member driving means has a convex portion to be supported by the first shaft retaining member.

Further, it is preferable that the rotating member driving means has a portion larger than the rotating member unit as projected from the insertion direction of the rotating member unit.

Further, it is preferable that the shaft is not rotatable.

Further, it is preferable that the rotating member driving means is slidable in the axial direction.

Further, it is preferable that the rotating member driving section has a coupling which connects the rotating member and the rotating member driving means and is slidable in the axial direction.

Further, it is preferable that the retainer comprises a rotating member driving means retaining member for retaining the rotating member driving section, the rotating member driving section comprises the rotating member driving means having a groove formed concentrically with the shaft, a holder which is retained by the rotating member driving means retaining member, a coupling which connects the rotating member and the rotating member driving means and is slidable in the axial direction within the holder, and an elastic member for allowing the coupling to slide, and at least a part of the coupling can move into the groove of the rotating member driving means.

Further, it is preferable that the rotating member unit comprises a pressing mechanism for pressing the rotating member toward the front in the insertion direction of the rotating member unit.

Further, it is preferable that the image forming apparatus comprises a plurality of the rotating member units and a plurality of the rotating member driving sections.

Still other objects and advantages of the invention will in part be obvious and will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
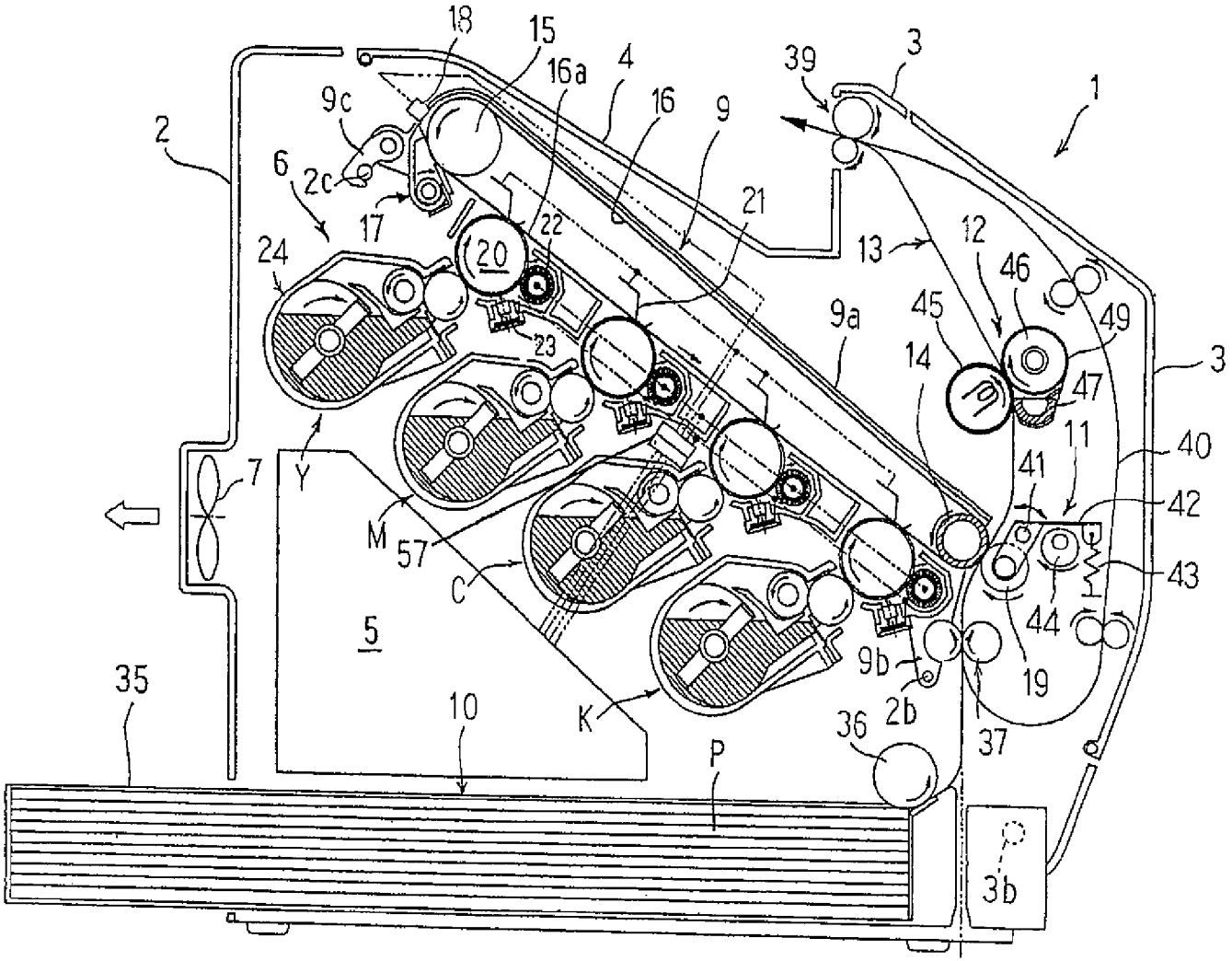
FIG. 1 is an illustration showing an image forming apparatus according to an embodiment of the invention.
Figure 2:
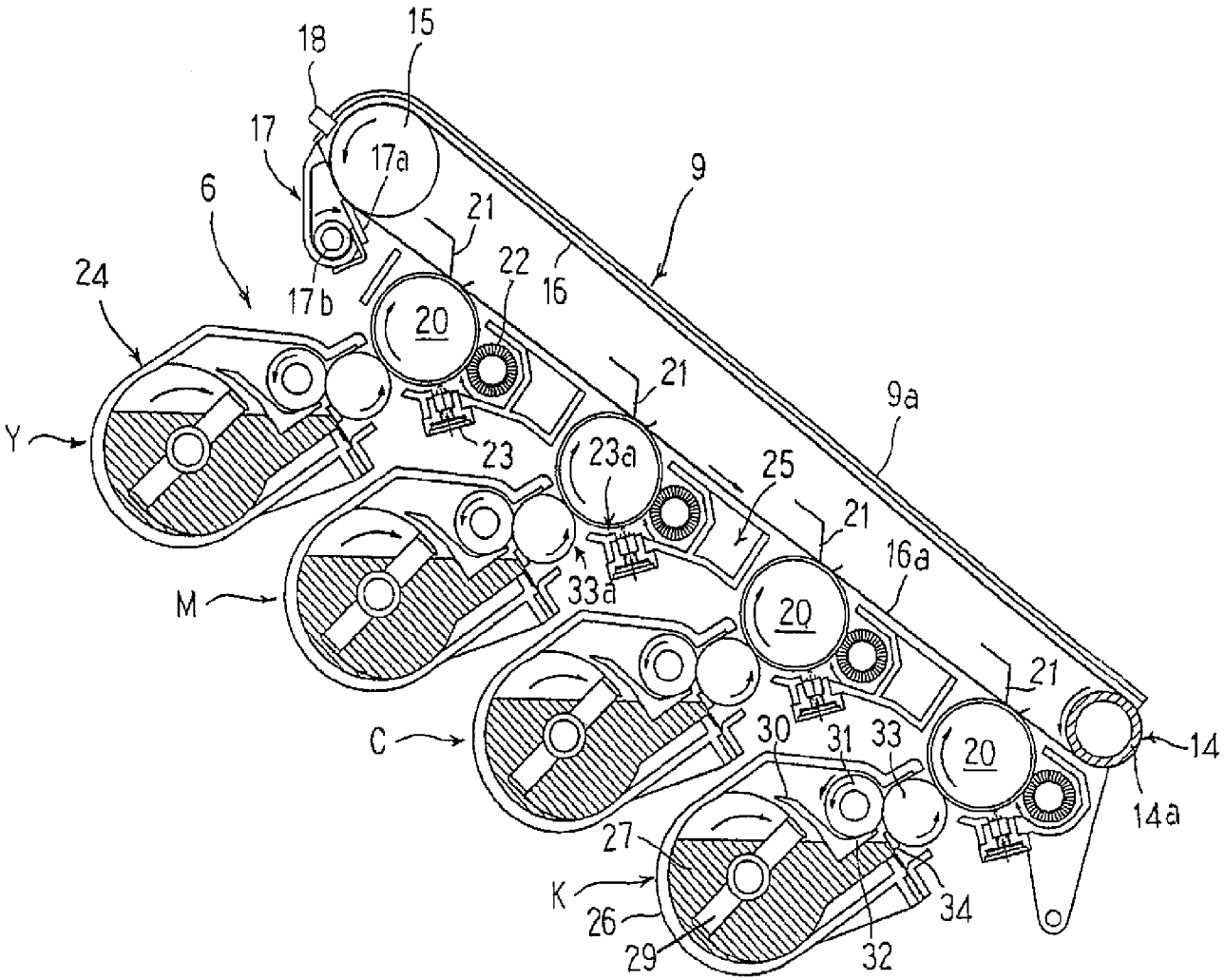
FIG. 2 is an illustration showing an image forming apparatus according to an embodiment of the invention.

Hereinafter, embodiments of the invention will be described with referred to the attached drawings. FIG. 1 is a schematic sectional view showing entire arrangement of an embodiment of an image forming apparatus of the invention. FIG. 2 is an enlarged view showing a transfer belt unit and an image forming unit of the embodiment shown in FIG. 1. In the following description, similar components in the respective drawings will be sometimes marked by the same numerals so that the description of such components will be omitted. It should be noted that, in this embodiment, an intermediate transfer belt is used as the transfer belt.

In FIG. 1, an image forming apparatus 1 of this embodiment comprises a housing body 2 as an example of the main body, a first door member 3 which is attached to the front of the housing body 2 in such a manner as to allow its opening and closing action, and a second door member (also functioning as a receiving tray) 4 which is attached to the top of the housing body 2 in such a manner as to allow its opening and closing action. The first door member 3 comprises a cover lid 3' which is attached to the front of the housing body in such a manner that the cover lid 3' can be opened and closed. The opening and closing of the cover lid 3' can be associated with the first door member 3 or independently conducted.

Arranged inside the housing body 2 are an electric component box 5 including a power circuit board and a control circuit board therein, an image forming unit 6, a blower fan 7, a transfer belt unit 9, and a feeder unit 10. Arranged inside the first door member 3 are a secondary transfer unit 11, a fixing unit 12, and a recording medium feeding means 13. Consumption articles in the image forming unit 6 and the feeder unit 10 are adapted to be detachable relative to the apparatus body. The repairs and replacements can be conducted by detaching also the transfer belt unit 9.

The transfer belt unit 9 comprises a driving roller 14 which is disposed in a lower part of the housing body 2 and is energized to rotate by a power source (not shown), a driven roller 15 which is disposed obliquely above the driving roller 14, an intermediate transfer belt 16 which laid to extend around and between the two rollers 14 and 15 with some tension and is driven to circle in a direction shown by an arrow in the drawing, and a cleaning means 17 which is in contact with the surface of the intermediate transfer belt 16. The driven roller 15 and the intermediate transfer belt 16 are arranged obliquely to the left of the driving roller 14 as seen in the drawing. Accordingly, the intermediate transfer belt 16 has a belt surface 16*a* which faces downward and of which belt carrying direction is descending when the intermediate transfer belt 16 is driven. In this embodiment, the belt surface 16*a* is a tensioned belt surface (pulled by the driving roller 14) when the intermediate transfer belt 16 is driven.

The driving roller 14 and the driven roller 15 are rotatably supported to a supporting frame 9*a*. Formed on the lower end of the supporting frame 9*a* is a bearing portion 9*b* which is fitted to a pivot pin 2*b* disposed on the housing body 2. Therefore, the supporting frame 9*a* is attached to the housing body 2 in such a manner as to allow the pivot movement thereof. On the other hand, a lock lever 9*c* is pivotally attached to the upper end of the supporting frame 9*a* such that the lock lever 9*c* can be engaged with an engaging shaft 2*c* disposed on the housing body 2.

The driving roller 14 also functions as a backup roller for the second transfer roller 19 as a component of the secondary transfer unit 11. The driving roller 14 has a rubber layer 14*a*, which is formed on the peripheral surface thereof and of which thickness is about 3 mm and volume resistivity is $10^5$ O·cm or less as shown in FIG. 2, and is earthed via a metallic shaft so as to function as a conductive passage for secondary transfer bias supplied via the secondary transfer roller 19. Because the rubber layer 14*a* has high friction property and impact absorbing property, impact caused when a recording medium enters into the secondary transfer section is hardly transmitted to the intermediate transfer belt 16, thereby preventing the deterioration of image quality.

In this embodiment, the diameter of the driving roller 14 is smaller than the diameter of the driven roller 15, thereby facilitating the separation of a recording medium after secondary transfer because of the elastic force of the recording medium itself. The driven roller 15 also functions as a backup roller for the cleaning means 17. The cleaning means 17 is positioned on a side of the belt surface 16*a* of which carrying direction is descending. As shown in FIG. 2, the cleaning means 17 comprises a cleaning blade 17*a* for removing toner particles remaining on the surface of the intermediate transfer belt 16 after secondary transfer and a toner carrying member 17*b* for carrying the collected toner particles. The cleaning blade 17*a* is in contact with a portion wound around the driven roller 15 of the intermediate transfer belt 16.

Primary transfer members 21 composed of plate spring electrodes are in elastic contact with the back of the belt surface 16*a*, of which carrying direction is descending, of the intermediate transfer belt 16 at positions corresponding to image carriers 20 of respective image forming stations Y, M, C, and K as will be described later. Transfer bias is applied to the primary transfer members 21. On the supporting frame 9*a* of the transfer belt unit 9, a test pattern sensor 18 is disposed in vicinity to the driven roller 15. The test pattern sensor 18 is a sensor for correcting color registration error among respective color images and image densities by positioning the respective color toner images on the intermediate transfer belt 16 and detecting densities of the respective color toner images.

The image forming unit 6 comprises image forming stations Y (yellow), M (magenta), C (cyan), and K (black) for forming plural (four in this embodiment) different color images. As best seen from FIG. 2, each of the respective image forming stations Y, M, C, and K comprises an image carrier 20 as a photosensitive drum and a charging means 22, an image writing means 23, and a developing means 24 which are arranged around the image carrier 20. It should be understood that the arrangement order of the image forming stations Y, M, C, and K may be any order.

The respective image carriers 20 of the image forming stations Y, M, C, and K are arranged to be in contact with the belt surface 16*a*, of which carrying direction is descending, of the intermediate transfer belt 16. As a result, the image forming stations Y, M, C, and K are arranged obliquely to the left relative to the driving roller 14 as seen in the drawing. The image carriers 20 are driven to rotate in the carrying direction of the intermediate transfer belt 16.

Each charging means 22 is composed of a conductive brush roller connected to a high voltage generating source and rotates with being in contact with the corresponding image carrier 20 in the same direction at a peripheral velocity two to three times higher than that of the image carrier 20 so as to uniformly charge the surface of the image carrier 20. The conductive brush roller is formed by spirally winding a pile fabric with 150,000-430,000 implanted fibers per square inch onto the surface of a well-conductive shaft member (for example, metal shaft) of 5-8 mm in diameter. The fibers are semi-conductive fibers of which thickness is 2-8 denier and basic fiber resistivity is $10^7$-$10^9$ O. The conductive brush roller is held rotatably to have a contact depth relative to the image carrier 20 of 0.3-0.5 mm.

When a negatively-charged image carrier is employed as the image carrier 20, the voltage to be applied to the brush roller is preferably a voltage composed of direct current components of −300--500 V and frequency of the order of 1 KHz alternative current components of 800-1300 V which are superimposed on the direct current components. In case of employing an image forming method of cleaner-less system, it is preferable that a bias of a polarity opposite to the charging polarity of toner is applied to the brush roller when image formation is not conducted, whereby post-transfer residual toner particles on the brush roller are released to the image carrier 20, then transferred at the primary transfer section to the intermediate transfer belt 16, and collected by the cleaning means 17 of the intermediate transfer belt 16.

By employing the charging means 22 as mentioned above, the surface of the image carrier can be charged with extremely small current, thereby preventing the outside and the inside of the apparatus from being contaminated by much ozone like corona charging method. In addition, since the contact relative to the image carrier 20 is soft, fixation of post-transfer residual toner onto the charging roller or the image carrier that frequently occurs in case of roller charging method hardly occurs, thereby ensuring stable image quality and reliability of the apparatus.

Each image writing means 23 is an array writing head in which elements such as light-emitting diodes or liquid-crystal shutters with backlights are aligned in rows in the axial direction of the image carrier 20. The array writing head has a light path length shorter than that of a laser scanning optical system and thus is compact so that it can be disposed in vicinity of the image carrier 20, that is, has an advantage of reducing the entire size of the apparatus. In this embodiment, the image carriers 20, the charging means 22, and image writing means 23 of the image forming stations Y, M, C and K are structured into a unit as an image carrier unit 25 (FIG. 2), whereby the positioning of the array writing heads is retained. When the image carrier unit 25 is replaced, the array writing heads are also replaced together. By conducting light intensity adjustment and positioning relative to a new image carrier unit, the image forming apparatus becomes reusable.

Now, the developing means 24 will be described in detail by taking the image forming station K shown in FIG. 2 as the representative example. In this embodiment, since the image stations Y, M, C and K are arranged obliquely and the image carriers 20 are in contact with the belt surface 16*a*, of which carrying direction is descending, of the intermediate transfer belt 16, the toner storing tanks 26 are arranged obliquely downward. Accordingly, special configuration is employed for the developing means 24.

The developing means 24 comprises a toner storing tank 26 in which toner (hatched in the drawing) is stored, a toner storing section 27 formed inside the toner storing tank 26, a toner agitating member 29 disposed in the toner storing section 27, a partition member 30 formed for partition in an upper portion of the toner storing section 27, a toner supplying roller 31 disposed above the partition member 30, a blade 32 which is formed on the partition member 30 and is in contact with the toner supplying roller 31, a development roller 33 which is disposed to be in contact with the toner supplying roller 31 and the image carrier 20, and a regulating blade 34 which is in contact with the development roller 33.

The image carrier 20 is rotated in the carrying direction of the intermediate transfer belt 16, and the development roller 33 and the supplying roller 31 are driven to rotate in a direction opposite to the rotational direction of the image carrier 20 as shown by arrows in the drawing. On the other hand, the agitating member 29 is driven to rotate in a direction opposite to the rotational direction of the supplying roller 31. Toner which is agitated and picked up by the agitating member 29 in the toner storing section 27 is supplied along the upper surface of the partition member 30 to the toner supplying roller 31. The toner is supplied to the surface of the development roller 33 by mechanical adhesive force of the surface roughness and adhesive force of frictional charging of the supplying roller 31 which frictionally slides on the blade 32. The toner supplied to the development roller 33 is regulated to be a thin layer of a predetermined thickness by the regulating blade 34. The thinned layer of toner is carried to the image carrier 20 so as to develop a latent image on the image carrier 20 at and around a nip portion where the development roller 33 and the image carrier 20 are in contact.

Referring back to FIG. 1, the feeder unit 10 comprises a feeder cassette 35 in which recording media P are stacked, and a pick-up roller 36 for feeding the recording media P one by one from the feeder cassette 35.

Arranged inside the first door member 3 are a pair of resist rollers 37 for regulating the timing of feeding the recording medium P to the secondary transfer section, a secondary transfer unit 11 as a secondary transfer means which is in press contact with the driving roller 14 and the intermediate transfer belt 16, a fixing unit 12, a recording medium carrying means 13, a pair of discharging rollers 39, and a dual-side printing feeding passage 40.

The secondary transfer unit 11 comprises a pivot lever 42 pivotally supported on a fixed shaft 41, a secondary transfer roller 19 rotatably disposed on one end of the pivot lever 42, and a spring 43 disposed between the other end of the pivot lever 42 and the first door member 3. Normally, the secondary transfer roller 19 is always biased by the biasing force of the spring 43 so as to move in directions of arrows so that the secondary transfer roller 19 can be pressed against the intermediate transfer belt 16 and the driving roller 14. Disposed on the spring side of the pivot lever 42 is an eccentric cam 44. The pivot lever 42, and the spring 43, and the eccentric cam 44 cooperate to compose a shifting means for the secondary transfer roller 19. By the rotation of the eccentric cam 44, the pivot lever 42 pivots against the spring 43 so as to separate the secondary roller 19 from the intermediate transfer belt 16.

The fixing unit 12 comprises a heat roller 45 which has a heating element such as a halogen heater therein and can be freely rotated, a pressing roller 46 for pressing the heat roller 45, a belt tensioning member 47 which is swingably disposed on the pressing roller 46, a heat-resistance belt 49 tensioned between the pressing roller 45 and the belt tensioning member 47. Color image secondarily transferred to the recording medium is fixed to the recording medium at the nip portion which is formed by the heating roller 45 and the heat-resistant belt 49 by heat of a predetermined temperature. In this embodiment, the fixing unit 12 can be arranged in a space formed obliquely above the intermediate transfer belt 16, that is, a space on the opposite side of image forming unit 6 relative to the intermediate transfer belt 16. Heat transfer to the electric component box 5, the image forming unit 6, and the intermediate transfer belt 16 can be lessened, thereby reducing the frequency of conducting the compensation operation for color registration error.

In the image forming apparatus of this embodiment, as shown in FIG. 1, the intermediate transfer belt 16 and the respective image forming stations Y, M, C, and K are arranged obliquely in the housing body 2 and the electric component box 5 is arranged vertically below the respective image forming stations Y, M, C, and K. The wirings from electric circuits such as a power supply circuit, a driving circuit, and a control circuit within the electric component box 5 are detachably connected via a connector 50 to the primary transfer member 21, the charging means 22, the image writing means 23, and the test pattern sensor 18. The wirings may be connected to the secondary transfer unit 11 and the fixing unit 12 in the first door member 3 via the connector 50 or through a space near a pivot shaft 3*b* of the first door member 3.

The actions of the image forming apparatus as a whole will be summarized as follows:

(1) As print command (image information signal) is inputted into a control circuit in the electric component box 5 from a host computer (not shown) (such as a personal computer) or the like, the image carriers 20 and the respective rollers of the developing means 24 of the image forming stations Y, M, C, and K, and the intermediate transfer belt 16 are driven to rotate.

(2) The outer surfaces of the image carriers 20 are uniformly charged by the charging means 22.

(3) The uniformly charged outer surface of the image carriers 20 in the image forming stations Y, M, C, and K are exposed to selective light corresponding to image information for the respective colors by the image writing means 23, thereby forming electrostatic latent images for the respective colors.

(4) The electrostatic latent images formed on the respective image carriers 20 are developed by the developing means 24 so as to form toner images.

(5) Primary transfer voltage of which polarity is opposite to the charging polarity of the toner is applied to the primary transfer member 21 of the intermediate transfer belt 16 so that the toner images formed on the image carriers 20 are sequentially transferred to the intermediate transfer belt 16 at the primary transfer section in accordance with the movement of the intermediate transfer belt 16 and superposed on the intermediate transfer belt 16.

(6) In synchronization with the movement of the intermediate transfer belt 16 with primarily transferred image, a recording medium P stored in the feeder cassette 35 is fed to the secondary transfer roller 19 through the pair of resist rollers 37.

(7) The primarily transferred image meets with the recording medium at the secondary transfer section. A bias of which polarity is opposite to that of the primarily transferred image is applied by the secondary transfer roller 19 pressed toward the driving roller 14 of the intermediate transfer belt 16 by a pressing mechanism so that the primarily transferred image formed on the intermediate transfer belt 16 is secondarily transferred to the recording medium which is fed synchronously.

(8) Post-transfer residual toner particles are carried to the driven roller 15 and thus scraped by the cleaning means 17 disposed to face the roller 15 so that the intermediate transfer belt 16 is refreshed and is allowed to be used again in the aforementioned cycle.

(9) The recording medium passes through the fixing means 12 whereby the toner image on the recording medium is fixed. After that, the recording medium is carried toward a predetermined position (the receiving tray 4 in case of non dual-side printing, or toward the both-side printing feeding passage 40 in case of dual-side printing.

Figure 3:
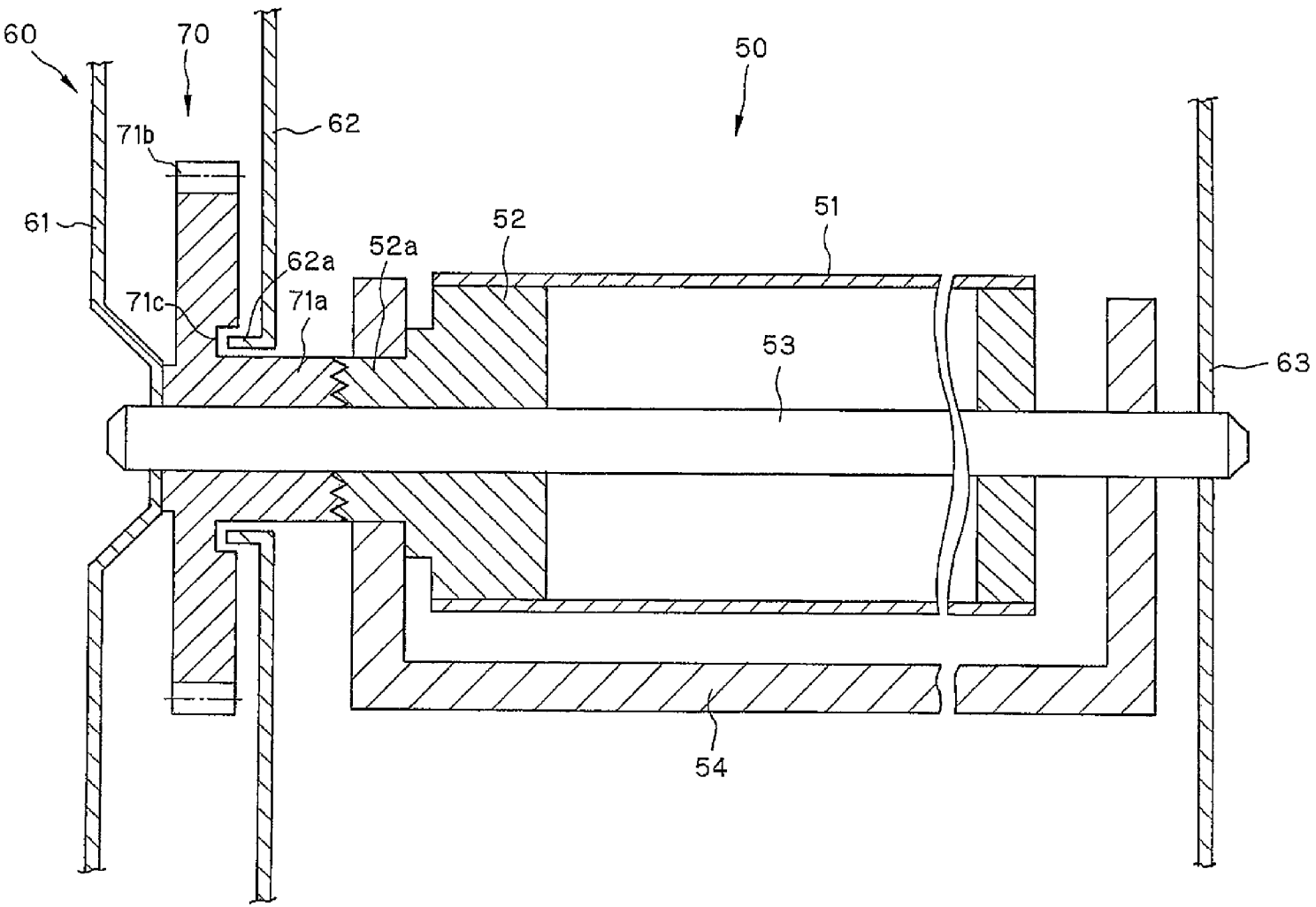
FIG. 3 is an illustration showing an embodiment of the invention.

Hereinafter, the features of the invention will be described. FIG. 3 is an embodiment of the image forming apparatus of the invention. In FIG. 3, numeral 50 designates an image carrier unit as an example of the rotating member unit, 51 designates an image carrier as an example of the rotating member, 52 designates a hub, 52*a* designates a connecting portion, 53 designates a shaft, 54 designates a chassis, 60 designates a retainer, 61 designates a first outer plate as an example of the first shaft retaining member, 62 designates an inner plate as an example of the rotating member driving means retaining member, 62*a* a image carrier driving gear retaining portion as an example of the rotating member driving means retaining portion, 63 designates a second outer plate as an example of the second shaft retaining member, 70 designates an image carrier driving section as an example of the rotating member driving section, 71 designates an image carrier driving gear as an example of the rotating member driving means, 71*a* is a connecting portion, 71*b* designates teeth, and 71*c* designates a groove.

The image carrier unit 50 has the image carrier 51, the hub 52, the shaft 53, and the chassis 54. The image carrier 51 is a cylindrical member provided at its end with the hub 52 and the shaft 53 penetrates the center of the image carrier 51. The hub 52 is disposed at the end of the image carrier 51 to support the shaft 53 and has the connecting portion 52*a* to be connected to the image carrier driving section 70 side. The connecting portion 52*a* has teeth which are configured to transmit driving force. The shaft 53 penetrates the image carrier 51, the hub 52, and the image carrier driving section 70 and is supported at its both ends by the retainer 60. The chassis 54 is a member supported by the shaft 53.

The retainer 60 has the first outer plate 61, the inner plate 62, and the second outer plate 63. The first outer plate 61 and the second outer plate 63 are members which are positioned outside the image carrier unit 50 and the image carrier driving section 70 to support the shaft 53 at the front side and the rear side relative to the insertion direction of the image carrier unit 50 and are made of steel plate or resin. The second outer plate 63 is allowed to be open. The inner plate 62 is disposed between the first outer plate 61 and the second outer plate 63 and between the image carrier unit 50 and the image carrier driving section 70 and is made of steel plate or resin. The image carrier driving means retaining portion 62*a* is a portion which is formed in the inner plate 62 to project into the groove 71*c* of the image carrier driving means 71 as will be described later. The retainer 60 may be made of a conductive material and thus used also as an earth for the image carrier 51.

The image carrier driving section 70 has the image carrier driving gear 71. Before the insertion of the shaft 53, the image carrier driving gear 71 is retained by the inner plate 62 between the first outer plate 61 and the image carrier unit 50 and the inner plate 62. After the insertion of the shaft 53, the image carrier driving gear 71 is supported by the shaft 53 and is driven to rotate by driving force of a motor (not shown) or the like so as to move the image carrier unit 50 by the driving force. The connecting portion 71*a* is a portion which is connected to the connecting portion 52*a* formed on the hub 52 of the image carrier 51 to transfer the driving force to the image carrier 51. The teeth 71*b* are formed in the outer periphery of the image carrier driving gear 71 to receive the driving force of the motor (not shown) or the like. The groove 71*c* is an annular depression formed around a through hole through which the shaft 53 penetrates and the image carrier driving means retaining portion 62*a* of the inner plate 62 protects into the groove 71*c*.

To assemble the image carrier driving section 70 to the aforementioned retainer 60, a shaft-like jig is inserted into the hole from the outside of the first outer plate 61 of the retainer 60 and the image carrier driving gear 71 and the inner plate 62 are fitted to the jig.

For making the image carrier unit 50, the retainer 60, and the image carrier driving section 70 of the image forming apparatus available for use, the second outer plate 63 is opened and the image carrier unit 50 is inserted. It is preferable that the motor (not shown) or the like is set not to be actuated when the image carrier unit 50 is not inserted. After the image carrier unit 50 is inserted, the image carrier driving gear 71 is driven to rotate by the driving force of the motor (not shown) or the like so that the driving force of the image carrier driving gear 71 is transmitted to the image carrier 51 from the connecting portion 71*a* through the connecting portion 52*a* of the hub 52, thereby activating them. During this, the shaft 53 may be adapted to rotate together with the image carrier 51 or not to rotate. If the shaft 53 is adapted not to rotate, vibration due to straightness of the shaft itself is never occurred so as to achieve high-accuracy rotation of the image carrier 51. Since the first outer plate 61 supporting the shaft 53 is positioned behind the image carrier driving gear 71 as seen from the insertion direction of the image carrier 51, the shaft 53 of the image carrier 51 can be a penetrating shaft, thereby improving the positioning accuracy of the image carrier 51.

Figure 4B:
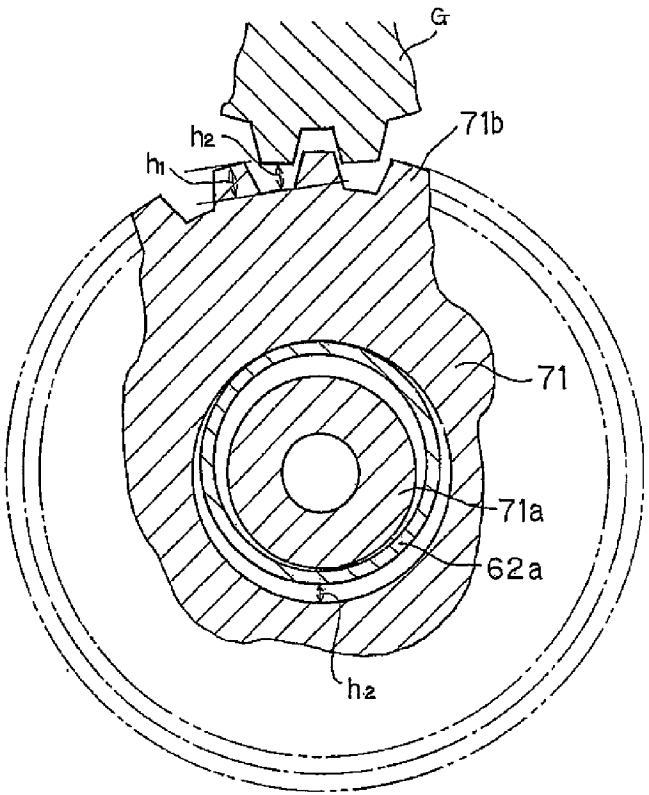
FIGS. 4*a* and 4*b* are illustrations showing the same as shown in FIG. 3 but is in a state after the shaft is removed.
Figure 4A:
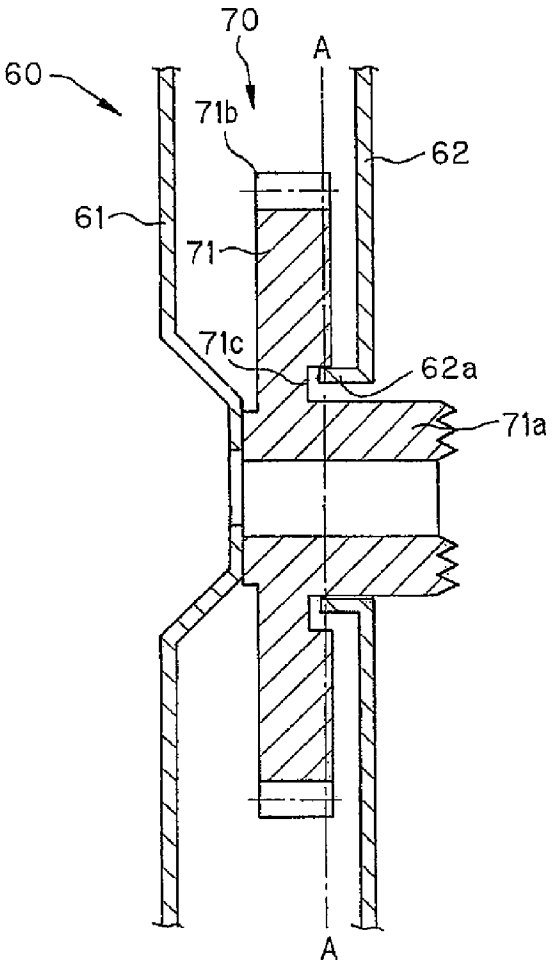

FIG. 4*a* shows a state of the retainer 60 and the image carrier driving section 70 before the image carrier unit 50 is inserted or after the image carrier unit 50 is removed and FIG. 4*b* is a sectional view taken along a line A-A. In FIGS. 4*a* and 4*b*, h1 indicates the height of the tooth and h2 indicates a dropping amount. Before the image carrier unit 50 is inserted or after the image carrier unit 50 is removed, the image carrier driving gear 71 of the image carrier driving section 70 loses the shaft 53 by which it is supported so that the image carrier driving gear 71 generally drops due to gravity and is supported at the outer periphery or the inner periphery of the groove 71*c* thereof by the projecting portion 62*a* of the inner plate 62. Since the image carrier driving gear 71 may come out of mesh with a gear G upstream of the image carrier driving gear 71 unless the dropping amount h2 is set to be lower than the height h1 of the tooth of the image carrier driving gear 71, the distance between the projecting portion 62*a* of the inner plate 62 and the outer periphery or the inner periphery of the groove 71*c* of the image carrier driving gear 71 is set to be smaller than h1. That is, the moving distance of the image carrier driving gear 71 from the state that the image carrier unit 50 is inserted to the state the image carrier unit 50 is not inserted is set to be shorter than the height of the tooth of the image carrier driving gear 71, thereby preventing the image carrier driving gear 71 from coming out of mesh with the upstream gear G.

Figure 5:
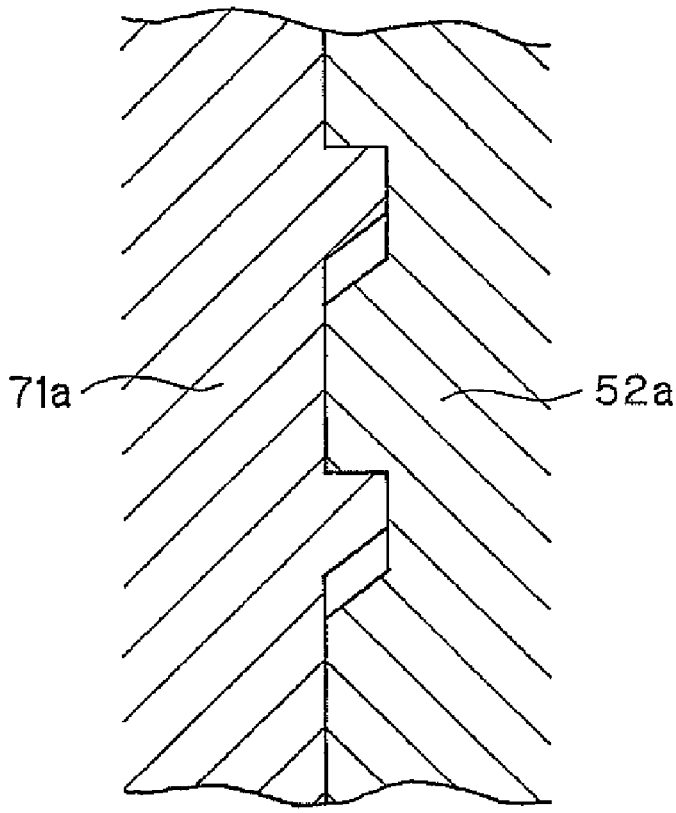
FIG. 5 is an illustration showing another embodiment of a connecting portion.

FIG. 5 shows another embodiment of the configuration between the connecting portion 52*a* formed in the hub 52 of the image carrier 51 and the connecting portion 71*a* of the image carrier driving gear 71. Each of the connecting portions 52*a*, 71*a* is composed of trapezoidal peaks and valleys which are alternately formed so as to allow transmission of driving force for rotation only in one direction.

Figure 6:
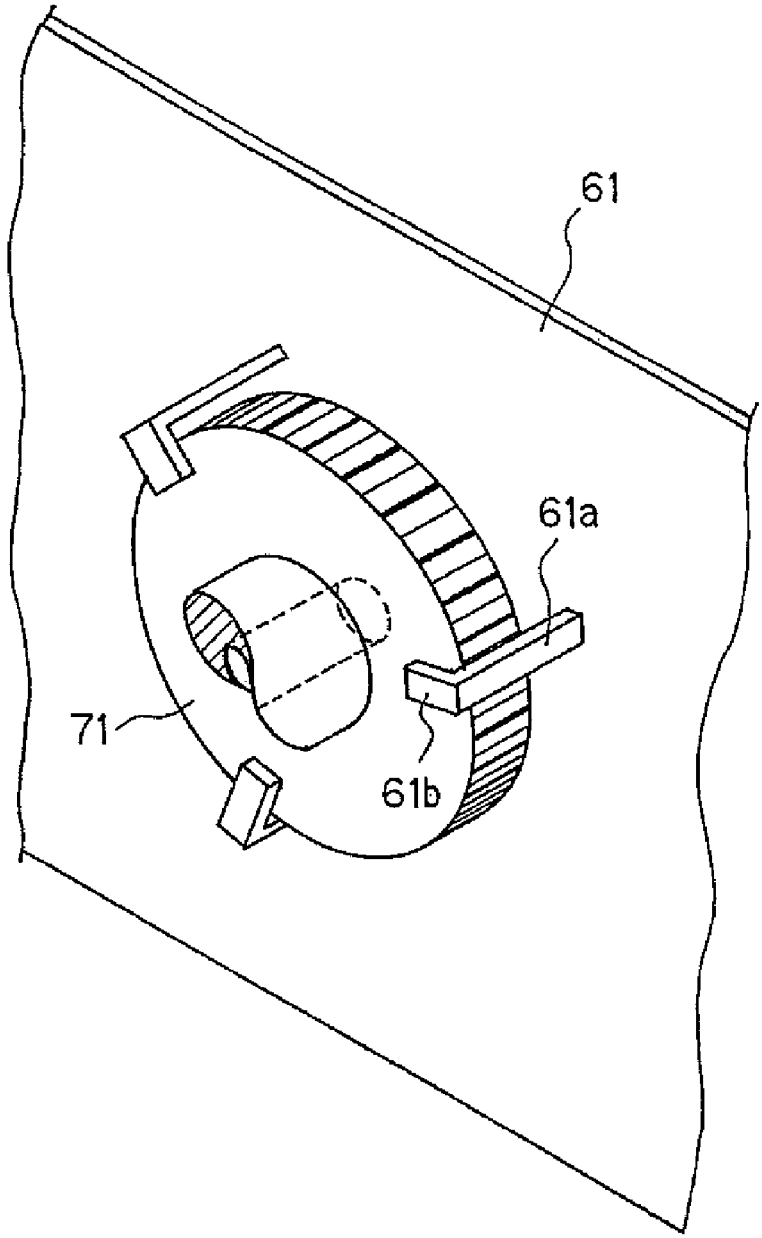
FIG. 6 is a perspective view showing another embodiment of a holding member.
Figure 7:
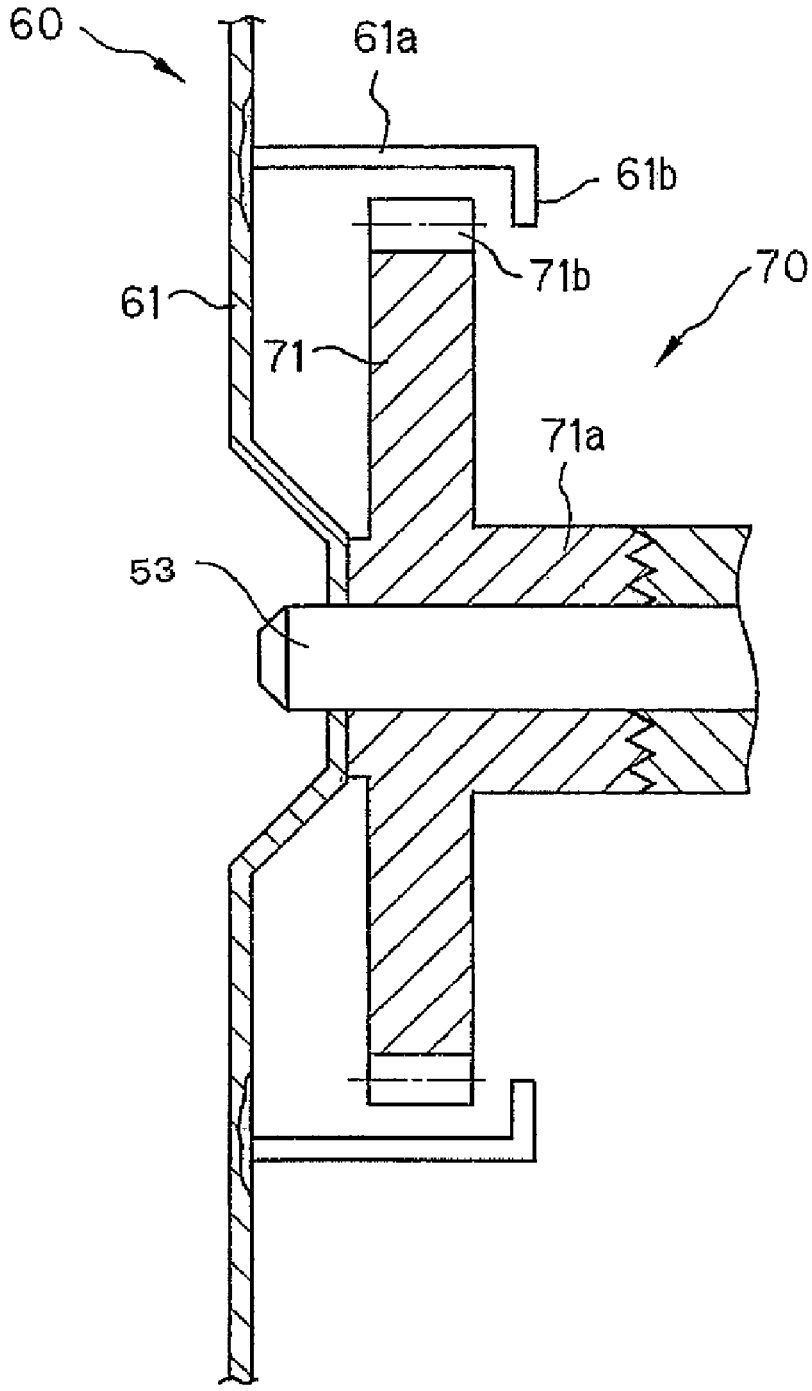
FIG. 7 is an illustration showing another embodiment of a holding member.

FIG. 6 and FIG. 7 show another embodiment of the retainer 60, FIG. 6 is a perspective view and FIG. 7 is a sectional view. In drawings, numeral 61*a* designates first extending portions and 61*b* designates second extending portions. The first extending portions 61*a* are portions extending inwardly from the first outer plate 61 outside the image carrier driving gear 71. The second extending portions 61*b* are portions further extending from the first extending portions 61*a* toward the center of the image carrier driving gear 71. In this embodiment, the image carrier driving gear 71 can be retained without the inner plate 62. In this case, the first outer plate 61 is preferably made of resin allowing elastic deformation so as to facilitate the assembly of the image carrier driving gear 71. As described in the above with reference to FIG. 4 and FIG. 5, the image carrier driving gear 71 of the image carrier driving section 70 loses the shaft 53 by which it is supported before the image carrier unit 50 is inserted or after the image carrier unit 50 is removed so that the image carrier driving gear 71 generally drops due to gravity and is retained by the inner surfaces of the first extending portions 61*a* of the first outer plate 61. Since the image carrier driving gear 71 may come out of mesh with a gear G upstream of the image carrier driving gear 71 unless the dropping amount h2 is set to be lower than the height h1 of the tooth of the image carrier driving gear 71, the distance between the inner surfaces of the first extending portions 61*a* of the first outer plate 61 and the outer periphery of the image carrier driving gear 71 is set to be smaller than h1. In this configuration, the inner plate 62 is not required, thereby reducing the number of parts and reducing the manufacturing cost, and also facilitating the assembly.

Figure 8:
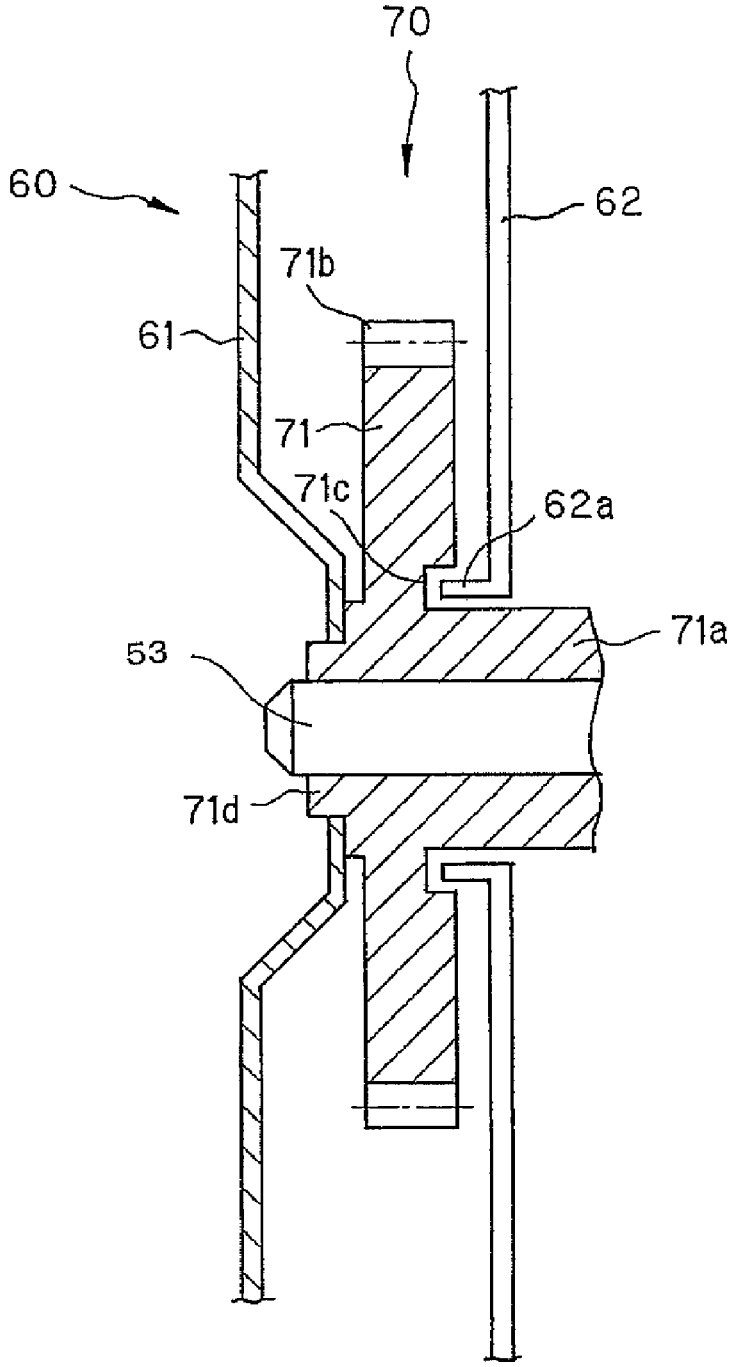
FIG. 8 is an illustration showing another embodiment of an image carrier drive gear.

FIG. 8 is an illustration showing another embodiment of the image carrier driving gear 71. In drawing, 71*d* designates a convex portion. In this embodiment, the convex portion 71*d* of the image carrier driving gear 71 is supported by the first outer plate 61. The other components are the same as those of the embodiment shown in FIG. 3. By configuring that the convex portion 71*d* of the image carrier driving gear 71 is supported by the first outer plate 61, the image carrier driving gear 71 is prevented from coming off and from coming out of mesh with the upstream gear.

Figure 9:
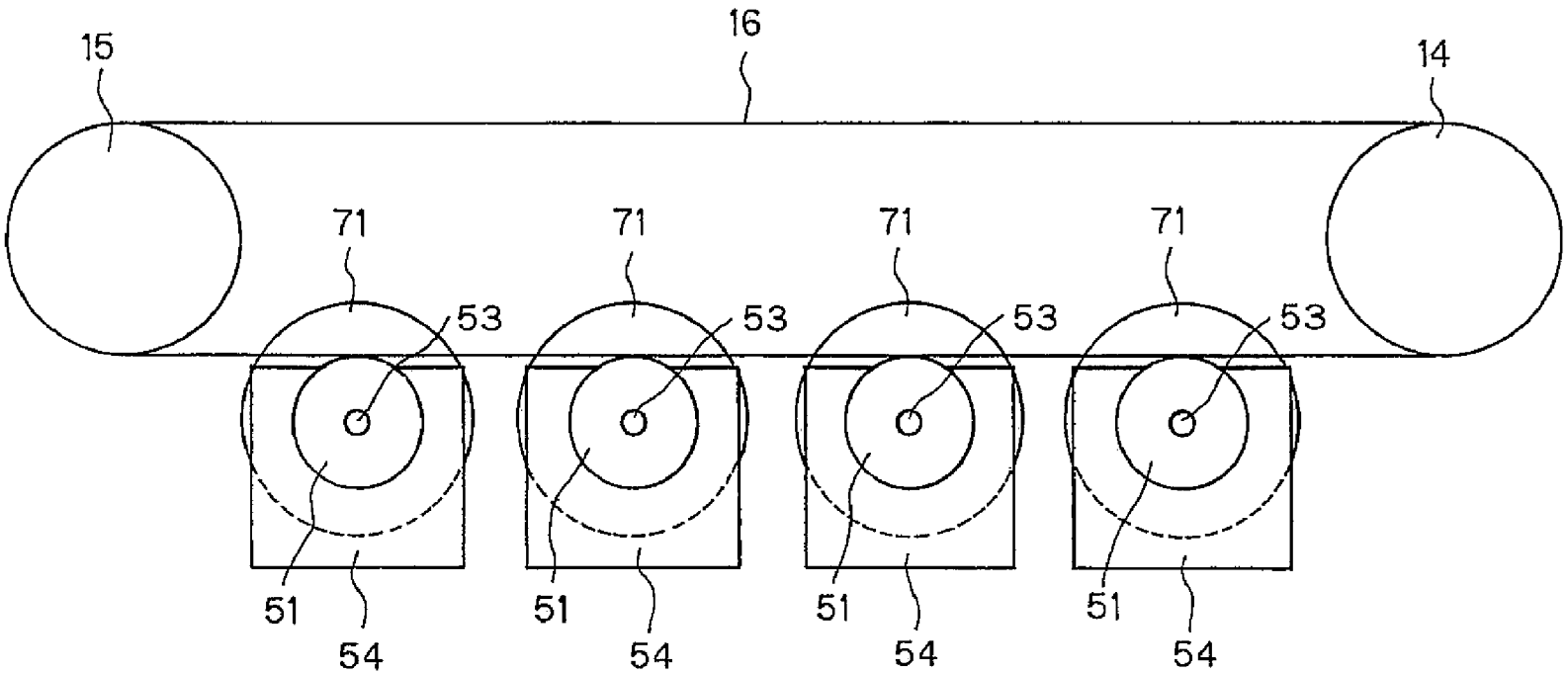
FIG. 9 is an illustration showing another embodiment of an image carrier drive gear.

FIG. 9 is an illustration showing another embodiment of the image carrier driving gear 71. In this embodiment, the outer size of the image carrier driving gear 71 is larger than the outer size of the image carrier 51 and larger than the outer size of the chassis 54. That is, the outer size of the image carrier driving gear 71 has a portion larger than the image carrier unit when projected from the insertion direction of the image carrier unit 50. The image carrier driving gear 71 is a separate member from the image carrier unit 50 and the first outer plate 61 for supporting the shaft 53 is positioned behind the image carrier driving gear 71 as seen from the insertion direction of the image carrier 51 so that the outer size of the image carrier driving gear 71 is allowed to be larger than the outer size of the image carrier 51 and the larger than the outer size of the chassis 54. Therefore, the number of teeth of the image carrier driving gear 71 is increased so as to improve the accuracy and to reduce the irregularity in rotation, thereby improving the quality.

Figure 10B:
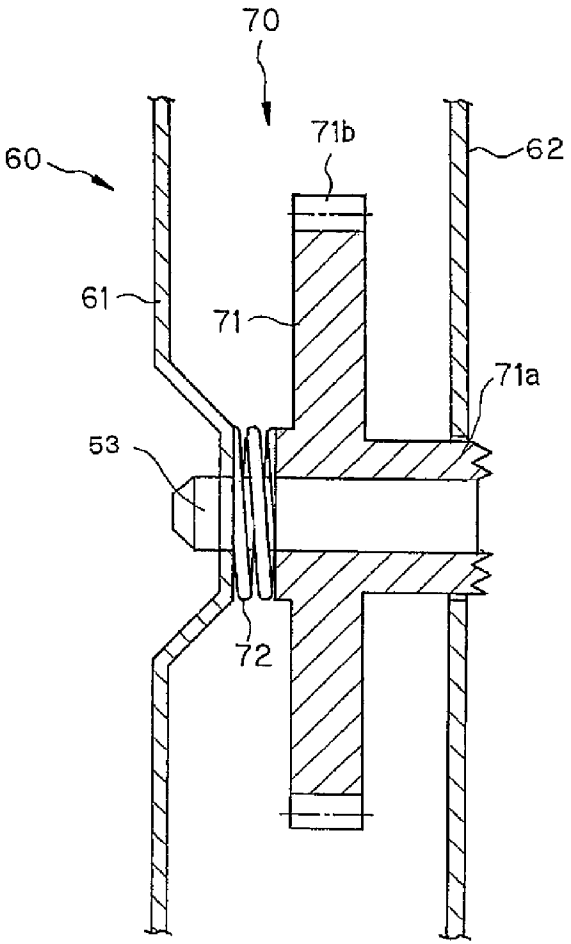
FIGS. 10*a* and 10*b* are illustrations showing another embodiment of an image carrier driving section.
Figure 10A:
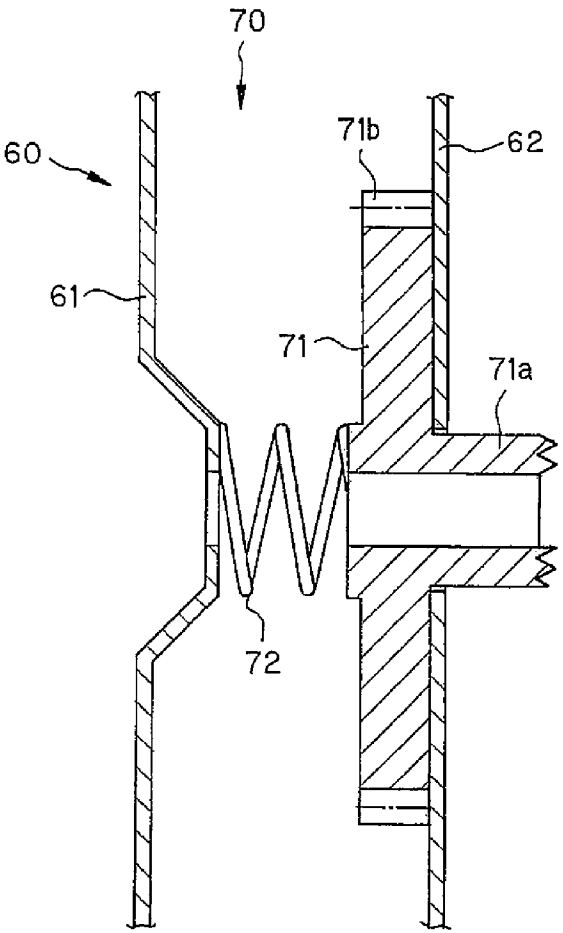

FIGS. 10*a* and 10*b* are illustrations showing another embodiment of the image carrier driving section 70. FIG. 10*a* is an illustration before the image carrier unit 50 is inserted and FIG. 10*b* is an illustration after the image carrier unit 50 is inserted. In drawings, a numeral 72 designates an image carrier driving section spring as an example of the rotating member driving section spring. In this embodiment, the spring 72 is disposed between the first outer plate 61 and the image carrier driving gear 71. By the image carrier driving section spring 72 as mentioned above, the image carrier driving gear 71 can be retained not to generally drop due to the gravity as shown in FIG. 10*a* before the image carrier unit 50 is inserted and after the image carrier unit 50 is removed. In addition, if the convexities of the connecting portions 52*a* and 71*a* between the image carrier 51 and the image carrier driving gear 71 collide with each other due to phase shifting during the insertion of the image carrier unit 50, the image carrier driving section spring 72 can compress so as to allow the sliding of the image carrier driving gear 71 along the extending direction of the shaft 53 and thus allow the second outer plate 63 to be closed. After that, as the image carrier 51 rotates, the phases are matched so that the image carrier 51 and the image carrier driving gear 71 are connected.

Figure 11:
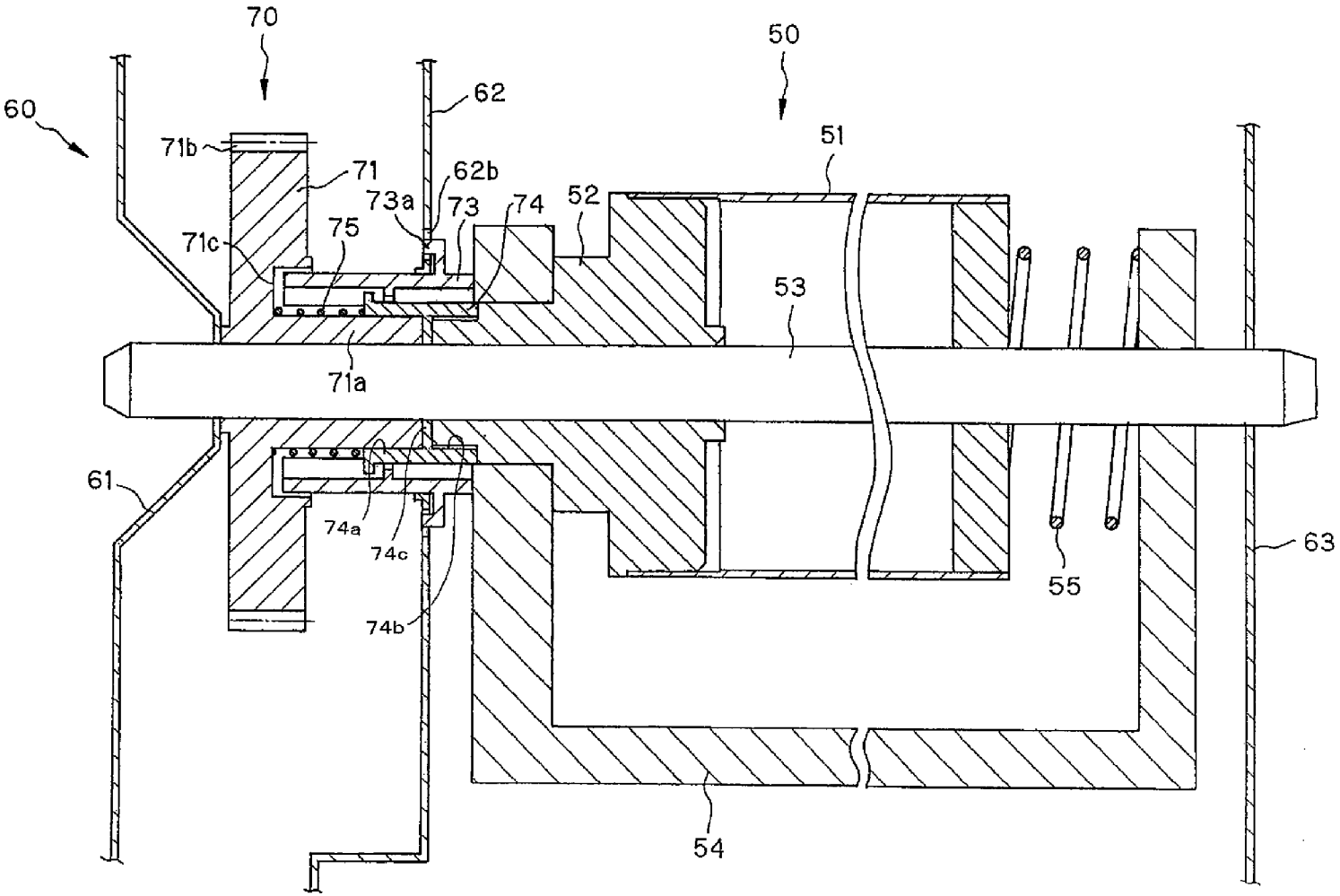
FIG. 11 is an illustration showing another embodiment of the invention.
Figure 12:
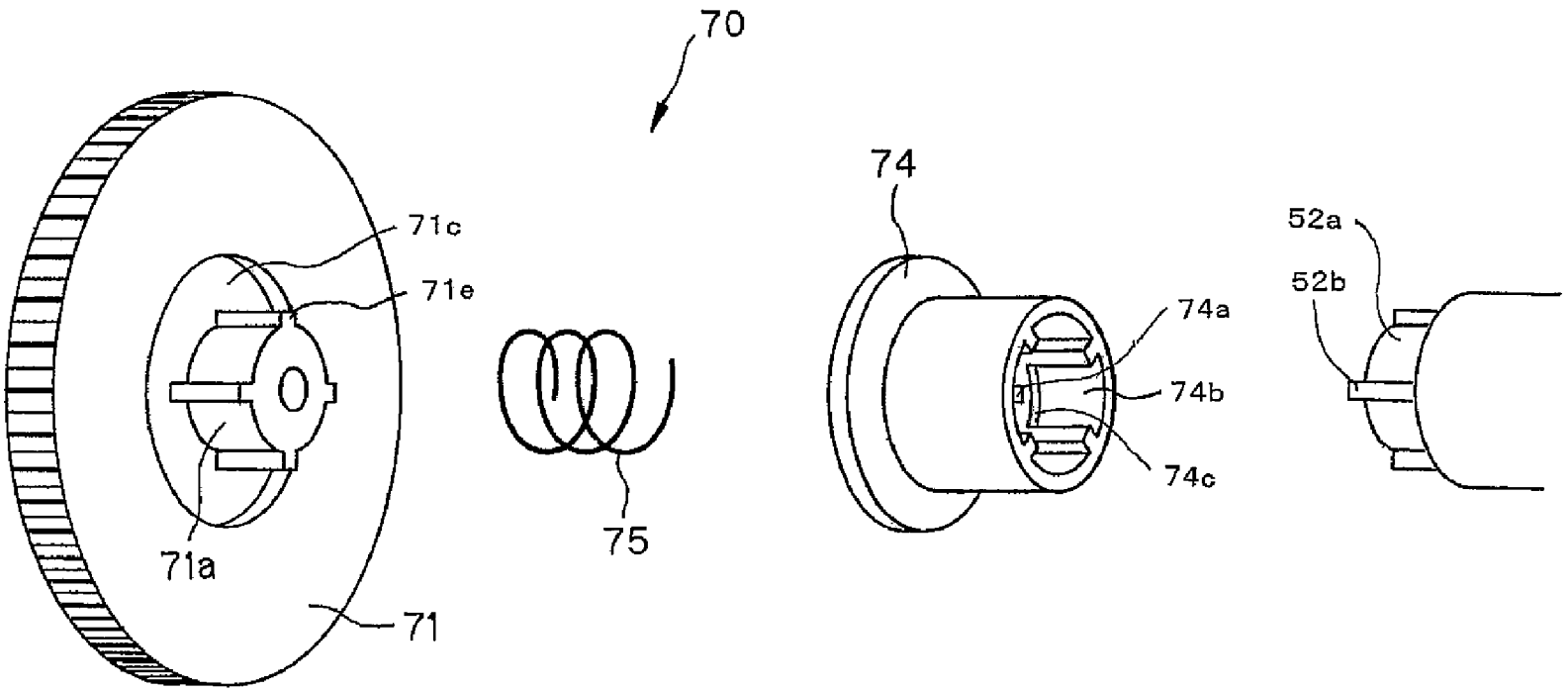
FIG. 12 is an illustration showing another embodiment of the invention.

FIG. 11 and FIG. 12 are illustrations showing another embodiment of the invention. In drawings, 52*b* designates second connection convexities, 55 designates an image carrier spring as an example of the pressing mechanism, 62*b* designates holes, 71*e* designates first connection convexities, 73 designates a holder, 73*a* designates projecting portions, 74 designates a coupling, 74*a* designates first connection concavities, 74*b* designates second connection concavities, 74*c* designates a partition, 75 designates a coupling spring as an example of the elastic member. In this embodiment, the connecting portion 71*a* of the image carrier driving gear 71 and the connecting portion 52*a* of the hub 52 are connected via the holder 73, the coupling 74, and the coupling spring 75.

The holder 73 is a cylindrical member which is fixed by the projecting portions 73*a* being fitted into the holes 62*b* and encloses the coupling 74 and the coupling spring 75 therein. The coupling 74 is a cylindrical member enclosed by the holder 73 and has the first connection concavities 74*a*, the second connection concavities 74*b*, and the partition 74*c* formed in the inner periphery thereof. The first connection concavities 74*a* are connected slidably in the axial direction to the first connection convexities 71*e* formed on the connecting portion 71*a* of the image carrier driving gear 71. The second connection concavities 74*b* are connected slidably in the axial direction to the second connection convexities 52*b* formed on the connecting portion 52*a* of the hub 52. The first connection convexities 71*e* formed on the connecting portion 71*a* of the image carrier driving gear 71 and the first connection concavities 74*a* of the coupling 74 are allowed little to move in the circumferential direction relative to each other. On the other hand, the second connection convexities 52*b* formed on the connecting portion 52*a* of the hub 52 and the second connection concavities 74*b* of the coupling 74 are allowed to rotate relative to each other in the circumferential direction by forming the second connection concavities 74*b* to be wide in the circumferential direction. According to this structure, the first connection convexities 71*e* formed on the connecting portion 71*a* of the image carrier driving gear 71 and the first connection concavities 74*a* of the coupling 74 enable quick transmission of driving force and the second connection convexities 52*b* formed on the connecting portion 52*a* of the hub 52 and the second connection concavities 74*b* of the coupling 74 facilitate the insertion of the image carrier unit 50 for assembling the image carrier unit 50 to the body. The partition 74 is a member for separating the connecting portion 71*a* of the image carrier driving gear 71 and the connecting portion 52*a* of the hub 52 and is disposed on the inner periphery of the coupling 74.

The coupling spring 75 is a spring disposed inside the holder 73 between the image carrier driving gear 71 and the coupling 74 to allow the axial sliding of the coupling 74. Normally, the coupling spring 75 biases the coupling 74 toward the second outer plate 63.

According to the structure, as the image carrier unit 50 is inserted into the retainer 60, the connecting portion 52*a* of the hub 52 is first inserted into the coupling 74. If the second connection convexities 52*b* of the connecting portion 52*a* are fitted into the second connection concavities 74*b* of the coupling 74, the connecting portion 52*a* is inserted into the coupling 74 without compression of the coupling spring 75. However, if the second connection convexities 52*b* of the connecting portion 52*a* are not fitted into the second connection concavities 74*b* of the coupling 74, the coupling 74 as a whole slides in the axial direction against the biasing force of the coupling spring 75 so as to allow the second outer plate 63 to be closed. At the start of driving the apparatus after that, the image carrier driving gear 71 rotates, whereby the second connection convexities 52*b* of the connecting portion 52*a* are fitted into the second connection concavities 74*b* of the coupling 74. That is, the image carrier unit 50 can be easily set without taking the phase between the hub 52 of the image carrier unit 50 and the image carrier driving gear 71 into consideration. The holder 73 is positioned within the groove 71*c* of the image carrier driving gear 71, thereby shortening the space in the axial direction.

Hereinafter, description will be made as regard to the image carrier spring 55. The image carrier spring 55 is a member which is disposed inside the chassis 54 of the image carrier unit 50 and between the image carrier 51 and the chassis 54 to bias the image carrier 51 in the axial direction toward the image carrier driving gear 71 and the front side in the insertion direction of the image carrier unit 50. This structure ensures the connection between the image carrier driving gear 71 and the image carrier. Though the spring is employed in this embodiment, the invention is not limited thereto. Any means capable of biasing or pressing the image carrier 51 in the axial direction toward the image carrier driving gear 71 may be employed.

Figure 13:
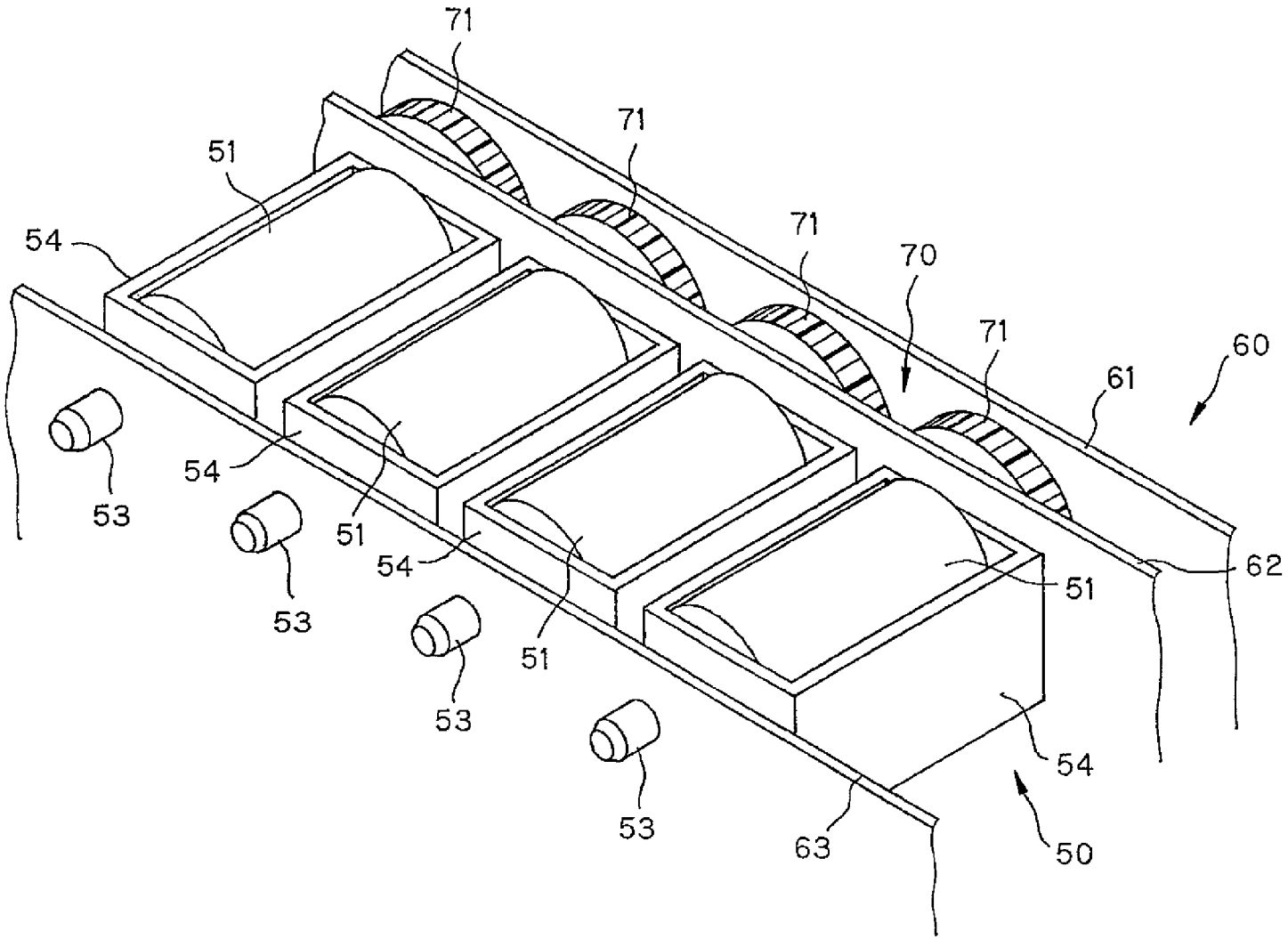
FIG. 13 is an illustration showing another embodiment of an image carrier drive gear.

FIG. 13 is a perspective view as seen from the second outer plate 63 side. The shaft 53 is supported by the first outer plate 61 and the second outer plate 63 and penetrates the second outer plate 63. According to this structure, the stabilization of the shaft 53 is ensured, thereby improving the positioning accuracy of the image carrier 51. There are a plurality of the image carriers 51 and the respective shafts 53 thereof are supported by the single first outer plate 61 and the single second outer plate 63, thereby improving the alignment accuracy of components and thus improving the positioning accuracy of the image carriers 51.

Figure 14:
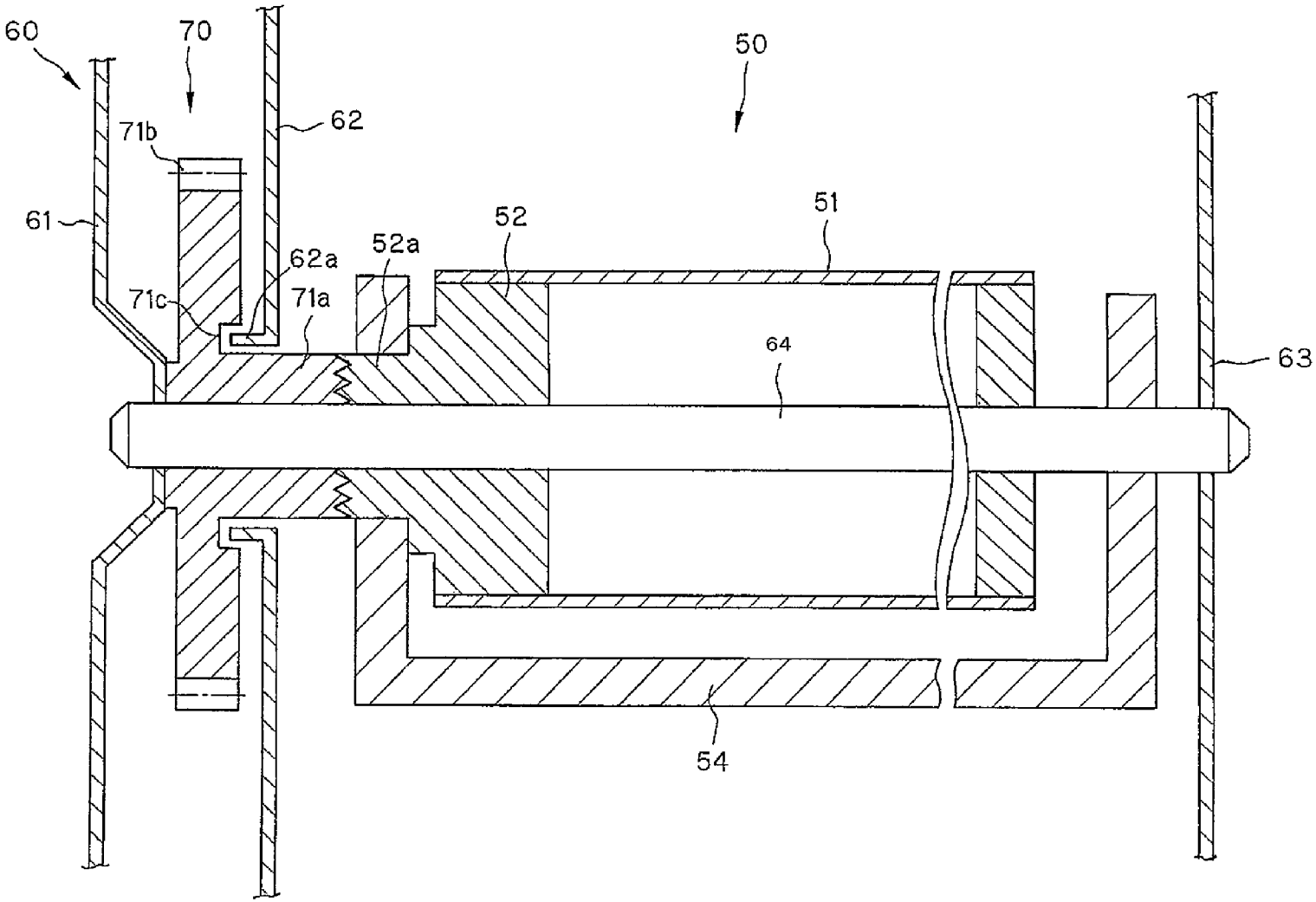
FIG. 14 is an illustration showing another embodiment of the invention.

Hereinafter, another embodiment of the invention will be described. FIG. 14 is an illustration showing another embodiment of the image forming apparatus of the invention. In the drawing, numeral 50 designates an image carrier unit as an example of the rotating member unit, 51 designates an image carrier as an example of the rotating member, 52 designates a hub, 52*a* designates a connecting portion, 54 designates a chassis, 60 designates a retainer, 61 designates a first outer plate as an example of the first shaft retaining member, 62 designates an inner plate as an example of the rotating member driving means retaining member, 62*a* designates a image carrier driving gear retaining portion as an example of the rotating member driving means retaining portion, 63 designates a second outer plate as an example of the second shaft retaining member, 64 designates a shaft, 70 designates an image carrier driving section as an example of the rotating member driving section, 71 designates an image carrier driving gear as an example of the rotating member driving means, 71*a* is a connecting portion, 71*b* designates teeth, and 71*c* designates a groove.

The image carrier unit 50 has the image carrier 51, the hub 52, and the chassis 54. The image carrier 51 is a cylindrical member provided at its end with the hub 52 and a hole through which the shaft 64 penetrates. The hub 52 is disposed at the end of the image carrier 51 and has the connecting portion 52*a* to be connected to the image carrier driving section 70 side. The connecting portion 52*a* has teeth which are configured to transmit driving force. The chassis 54 is a member supported by the shaft 64.

The retainer 60 has the first outer plate 61, the inner plate 62, the second outer plate 63, and the shaft 64. The first outer plate 61 and the second outer plate 63 are members which are positioned outside the image carrier unit 50 and the image carrier driving section 70 to support the shaft 64 and are made of steel plate or resin. The first outer plate 61 supports the shaft 64 rotatably or non-rotatably such that the shaft 64 is non-detachably fixed to the first outer plate 61. The second outer plate 63 is allowed to be open. The inner plate 62 is disposed between the first outer plate 61 and the second outer plate 63 and between the image carrier unit 50 and the image carrier driving section 70 and is made of steel plate or resin. The image carrier driving means retaining portion 62*a* is a portion which is formed in the inner plate 62 to project into the groove 71*c* of the image carrier driving gear 71 as will be described later. The retainer 60 may be made of a conductive material and thus used also as an earth for the image carrier 51.

The image carrier driving section 70 has the image carrier driving gear 71. The image carrier driving gear 71 is supported by the shaft 64 between the first outer plate 61 and the inner plate 62 and is driven to rotate by driving force of a motor (not shown) or the like so as to move the image carrier unit 50 by the driving force. The connecting portion 71*a* is a portion which is connected to the connecting portion 52*a* formed on the hub 52 of the image carrier 51 to transfer the driving force to the image carrier 51. The teeth 71*b* are formed in the outer periphery of the image carrier driving gear 71 to receive the driving force of the motor (not shown) or the like. The groove 71*c* is an annular depression formed around a through hole through which the shaft 64 penetrates and the image carrier driving means retaining portion 62*a* of the inner plate 62 protects into the groove 71*c*.

To assemble the image carrier driving section 70 to the aforementioned retainer 60, a shaft-like jig is inserted into the hole from the outside of the first outer plate 61 of the retainer 60 and the image carrier driving gear 71 and the inner plate 62 are fitted to the jig.

For making the image carrier unit 50, the retainer 60, and the image carrier driving section 70 of the image forming apparatus available for use, the second outer plate 63 is opened and the image carrier unit 50 is inserted. It is preferable that the motor (not shown) or the like or the image carrier driving section 70 is set not to be actuated when the image carrier unit 50 is not inserted. After the image carrier unit 50 is inserted, the image carrier driving gear 71 is driven to rotate by the driving force of the motor (not shown) or the like so that the driving force of the image carrier driving gear 71 is transmitted to the image carrier 51 from the connecting portion 71*a* through the connecting portion 52*a* of the hub 52, thereby activating them. During this, the shaft 64 may be adapted to rotate together with the image carrier 51 or not to rotate. If the shaft 64 is adapted not to rotate, vibration due to straightness of the shaft itself is never occurred so as to achieve high-accuracy rotation of the image carrier 51. Since the first outer plate 61 supporting the shaft 64 is positioned behind the image carrier driving gear 71 as seen from the insertion direction of the image carrier 51, the shaft 64 functions as a penetrating shaft relative to the image carrier 51, thereby improving the positioning accuracy of the image carrier 51.

Figure 15:
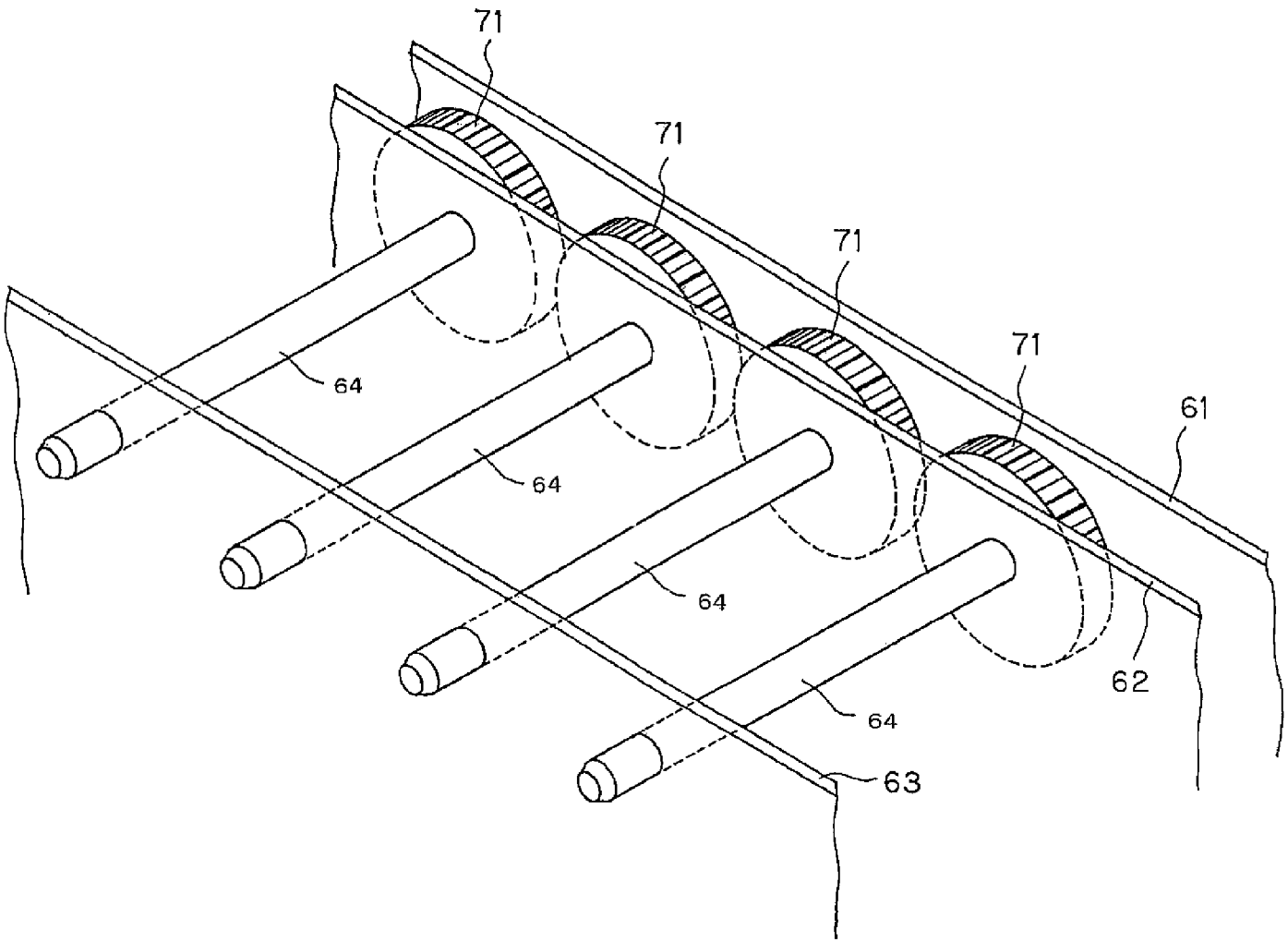
FIG. 15 is an illustration showing the state before an image carrier unit is inserted.

FIG. 15 is a perspective view of the embodiment shown in FIG. 14 before the image carrier unit 50 is inserted. For inserting the image carrier unit 50, the second outer plate 63 is opened and the image carrier unit 50 is fitted to the shafts 64, and then the second outer plate 63 is closed.

Figure 16:
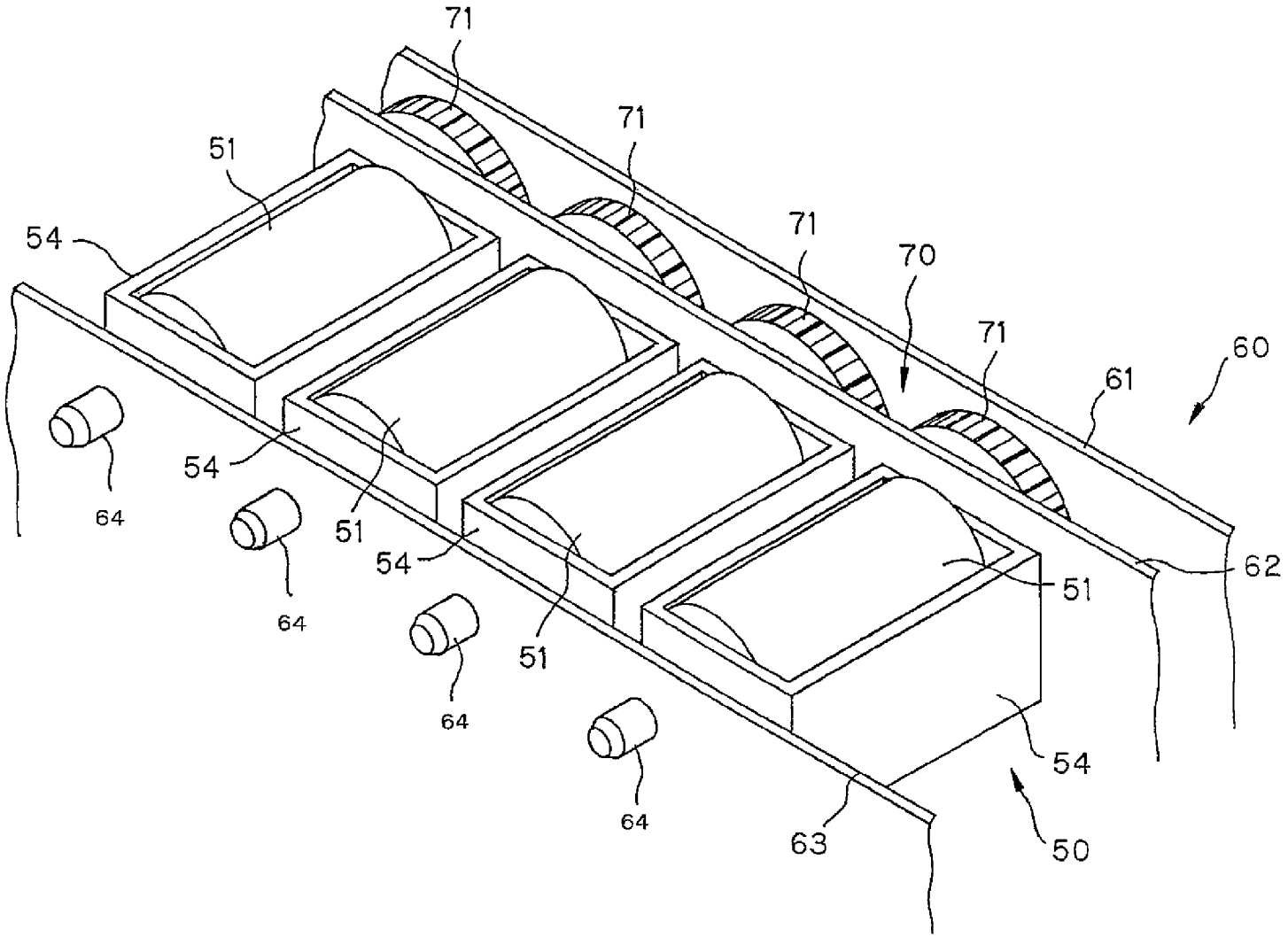
FIG. 16 is an illustration showing another embodiment of an image carrier drive gear.

FIG. 16 is a perspective view taken from the second outer plate 63 side. The shaft 64 is supported by the first outer plate 61 and the second outer plate 63 and penetrates the second outer plate 63. According to this structure, the stabilization of the shaft 64 is ensured, thereby improving the positioning accuracy of the image carrier 51. There are a plurality of the image carriers 51 and the respective shafts 64 thereof are supported by the single first outer plate 61 and the single second outer plate 63, thereby improving the alignment accuracy of components and thus improving the positioning accuracy of the image carriers 51.

Figure 17:
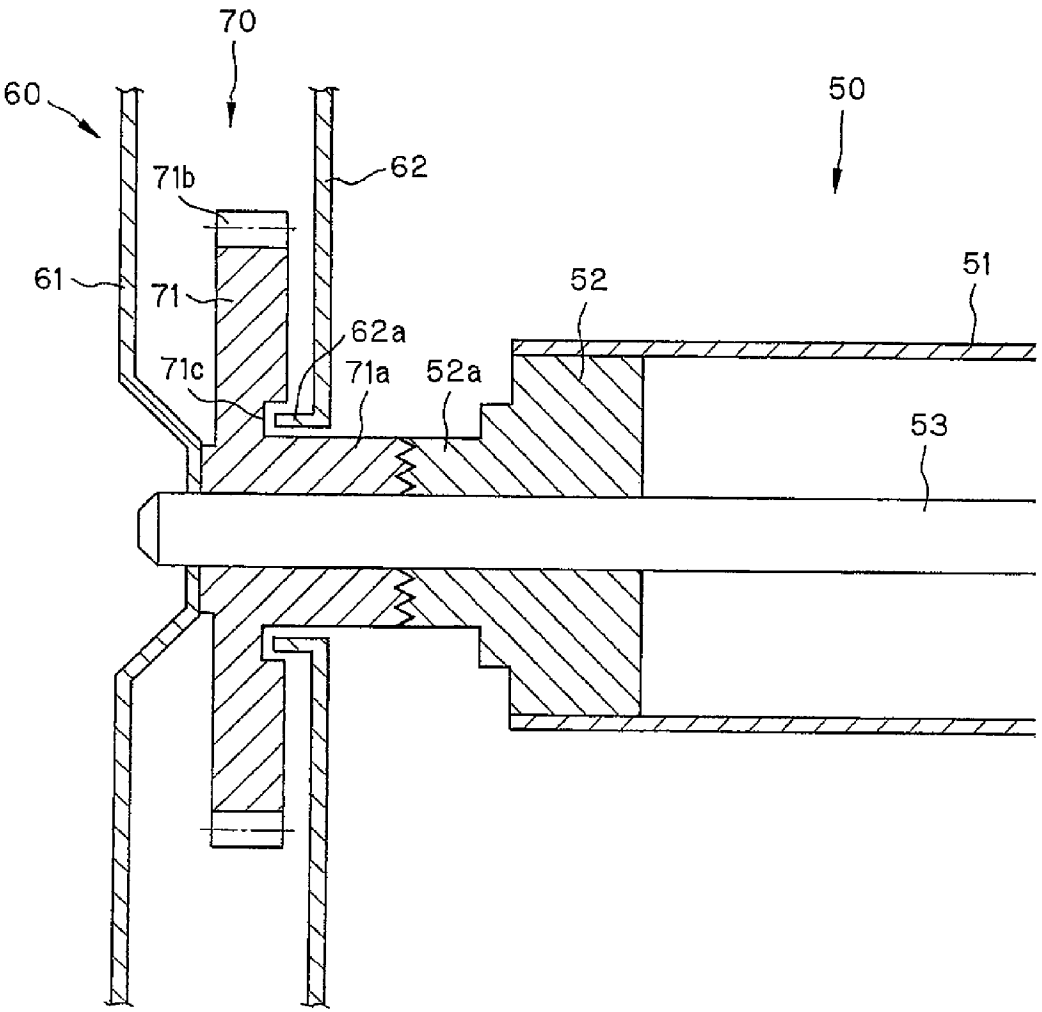
FIG. 17 is illustrations showing another embodiment of the invention.

Though any of the embodiments of the invention has been described taking the image carrier unit 50 as an example of the rotating member, the invention can be applied to a rotating member without the chassis 54 such as a development roller or a charging roller as shown in FIG. 17.

According to the invention, the shaft of the rotating member can be a penetrating shaft, thereby reducing the axis deviation and thus improving the positional accuracy. In addition, the rotating member driving means can have a larger outer size, thereby reducing the irregularity in rotation and thus improving the quality. Further, the rotating member driving means is prevented from coming off and from coming out of mesh with the upstream gear. Furthermore, when the shaft is adapted not to rotate, vibration due to straightness of the shaft itself is never occurred so as to achieve high-accuracy rotation of the rotating member. Since the rotating member driving section has a slidable member, easy phase fitting and connection between the rotating member and the rotating member driving means are allowed, thereby smoothly setting the rotating member unit. Moreover, at least a part of the coupling can move into the groove of the rotating member driving means, thereby shortening the axial space. Since the rotating unit has a pressing mechanism for pressing the rotating member to toward the front in the insertion direction of the rotating member, the rotating member can be one-sided. The apparatus comprises a plurality of the rotating member units and a plurality of rotating member driving sections, and the rotating units can be supported by the shaft supporting member, thereby reducing the number of components and improving the positioning accuracy.

What is claimed is:

1. An image forming apparatus comprising a main body and a rotating member unit having a rotating member, the rotating member unit being detachably held in the main body, wherein the main body has a retainer which retains a shaft penetrating and supporting the rotating member, and the retainer has a first shaft retaining member which supports the shaft at a front side as seen from the insertion direction of the rotating member unit, the main body is provided with a rotating member driving section for driving the rotating member, the rotating member driving section has a rotating member driving means disposed between the first shaft retaining member and the rotating member and retained on the main body side of the image forming apparatus in a state that the rotating member is inserted, and the rotating member driving means has a convex portion to be supported by the first shaft retaining member.

2. An image forming apparatus comprising a main body and a rotating member unit having a rotating member, the rotating member unit being detachably held in the main body, wherein the main body of the image forming apparatus has a retainer which retains a shaft penetrating and supporting the rotating member, and the retainer has a first shaft retaining member which supports the shaft at a front side as seen from the insertion direction of the rotating member unit, the main body of the image forming apparatus is provided with a rotating member driving section for driving the rotating member, the rotating member driving section has a rotating member driving means disposed between the first shaft retaining member and the rotating member and retained on the main body side of the image forming apparatus in a state that the rotating member is inserted, and the rotating member driving means is a gear, and the moving distance of the gear from the state that the rotating member unit is inserted to a state that the rotating member unit is not inserted is shorter than a height of a tooth of the gear.

3. An image forming apparatus as claimed in claim 2, wherein the rotating member unit has the shaft penetrating and supporting the rotating member.

4. An image forming apparatus as claimed in claim 2, wherein the main body has the shaft penetrating and supporting the rotating member.

5. An image forming apparatus as claimed in claim 2, wherein the image forming apparatus has a second shaft retaining member which retains the shaft at a rear side as seen from the insertion direction of the rotating member unit.

6. An image forming apparatus as claimed in claim 5, wherein the second shaft retaining member is allowed to be opened and closed.

7. An image forming apparatus as claimed in claim 2, wherein the image forming apparatus comprises a rotating member driving means retaining portion for preventing the rotating member driving means from coming off.

8. An image forming apparatus as claimed in claim 2, wherein the rotating member driving means has a portion larger than the rotating member unit as projected from the insertion direction of the rotating member unit.

9. An image forming apparatus as claimed in claim 2, wherein the shaft is not rotatable.

10. An image forming apparatus as claimed in claim 2, wherein the image forming apparatus comprises a plurality of the rotating member units and a plurality of the rotating member driving sections.

11. An image forming apparatus comprising a main body and a rotating member unit having a rotating member, the rotating member unit being detachably held in the main body, wherein the main body has a retainer which retains a shaft penetrating and supporting the rotating member, and the retainer has a first shaft retaining member which supports the shaft at a front side as seen from the insertion direction of the rotating member unit, the main body is provided with a rotating member driving section for driving the rotating member, the rotating member driving section has a rotating member driving means disposed between the first shaft retaining member and the rotating member and retained on the main body side of the image forming apparatus in a state that the rotating member is inserted, and the rotating member driving means is slidable in an axial direction.

12. An image forming apparatus comprising a main body and a rotating member unit having a rotating member, the rotating member unit being detachably held in the main body, wherein the main body has a retainer which retains a shaft penetrating and supporting the rotating member, and the retainer has a first shaft retaining member which supports the shaft at a front side as seen from the insertion direction of the rotating member unit, the main body is provided with a rotating member driving section for driving the rotating member, the rotating member driving section has a rotating member driving means disposed between the first shaft retaining member and the rotating member and retained on the main body side of the image forming apparatus in a state that the rotating member is inserted, and the rotating member driving section has a coupling which connects the rotating member and the rotating member driving means and is slidable in an axial direction.

13. An image forming apparatus comprising a main body and a rotating member unit having a rotating member, the rotating member unit being detachably held in the main body, wherein the main body has a retainer which retains a shaft penetrating and supporting the rotating member, and the retainer has a first shaft retaining member which supports the shaft at a front side as seen from the insertion direction of the rotating member unit, the main body is provided with a rotating member driving section for driving the rotating member, the rotating member driving section has a rotating member driving means disposed between the first shaft retaining member and the rotating member and retained on the main body side of the image forming apparatus in a state that the rotating member is inserted, and the retainer comprises a rotating member driving means retaining member for retaining the rotating member driving section, the rotating member driving section comprises the rotating member driving means having a groove formed concentrically with the shaft, a holder which is retained by the rotating member driving means retaining member, a coupling which connects the rotating member and the rotating member driving means and is slidable in an axial direction within the holder, and an elastic member for allowing the coupling to slide, and at least a part of the coupling can move into the groove of the rotating member driving means.

14. An image forming apparatus comprising a main body and a rotating member unit having a rotating member, the rotating member unit being detachably held in the main body, wherein the main body has a retainer which retains a shaft penetrating and supporting the rotating member, and the retainer has a first shaft retaining member which supports the shaft at a front side as seen from the insertion direction of the rotating member unit, the main body is provided with a rotating member driving section for driving the rotating member, the rotating member driving section has a rotating member driving means disposed between the first shaft retaining member and the rotating member and retained on the main body side of the image forming apparatus in a state that the rotating member is inserted, and the rotating member unit comprises a pressing mechanism for pressing the rotating member toward the front in the insertion direction of the rotating member unit.

* * * * *